US005495886A

United States Patent [19]

Kolesnichenko

[11] Patent Number: 5,495,886

[45] Date of Patent: Mar. 5, 1996

[54] APPARATUS AND METHOD FOR SIDEWALL CONTAINMENT OF MOLTEN METAL WITH VERTICAL MAGNETIC FIELDS

[75] Inventor: Anatoly F. Kolesnichenko, Kieve, Ukraine

[73] Assignee: Inland Steel Company, Chicago, Ill.

[21] Appl. No.: 236,366

[22] Filed: Apr. 29, 1994

[51] Int. Cl.[6] ..... B22D 11/06; B22D 27/02

[52] U.S. Cl. ..... 164/467; 164/480; 164/428; 164/503

[58] Field of Search ..... 164/480, 428, 164/467, 503

[56] References Cited

U.S. PATENT DOCUMENTS

| | | | |
|---|---|---|---|
| 4,020,890 | 5/1977 | Olsson | 164/466 |
| 4,936,374 | 6/1990 | Pareg | 164/503 |
| 4,974,661 | 12/1990 | Lari et al. | 164/503 |
| 5,197,534 | 3/1993 | Gerber et al. | 164/467 |
| 5,197,535 | 3/1993 | Mulcahy | 164/468 |
| 5,251,685 | 10/1993 | Praeg | 164/467 |
| 5,279,350 | 1/1994 | Gerber | 164/467 |

FOREIGN PATENT DOCUMENTS

| | | | |
|---|---|---|---|
| 62-104653 | 5/1987 | Japan | 164/480 |
| WO93/11893 | 6/1993 | WIPO | 164/480 |

OTHER PUBLICATIONS

Serial No. 08/220,789 Gerber Mar. 31, 1994.

Kolesnichenko, et al., "Electromagnetic Retention of Steel Melt on the Faces of the Roll Mould" *Proceedings of The Sixth International Iron and Steel Congress,* vol. 4, 1990, Nagoya, ISIJ, pp. 446–453.

*Primary Examiner*—Kuang Y. Lin

*Attorney, Agent, or Firm*—Marshall, O'Toole, Gerstein, Murray & Borun

[57] ABSTRACT

A magnetic confining method and apparatus in accordance with the present invention generates, adjacent the open side of the roller gap, a primary vertical magnetic field (a) resulting from direct current (D.C.) or alternating current (A.C.) flowing through a coil surrounding a core of a primary electromagnet or (b) resulting from an induced horizontal current flowing through roller shafts, roller sleeves and the edge of the molten metal. There are one or more additional vertical magnetic fields, that serve to concentrate and/or shape the primary magnetic field, and the vertical fields combine to provide electromagnetic forces sufficient for containment of the molten metal in the vertical gap between the rollers. Both the primary vertical field and one or more additional or secondary vertical magnetic fields extend through the open side of the gap to the molten metal in the gap. The combination of magnetic fields cooperate to provide sufficient electromagnetic force over the depth of the molten metal, at the molten metal sidewall to electromagnetically confine the molten metal within the gap between the rollers and stabilize the molten metal at the sidewall.

79 Claims, 9 Drawing Sheets

FIG. 2
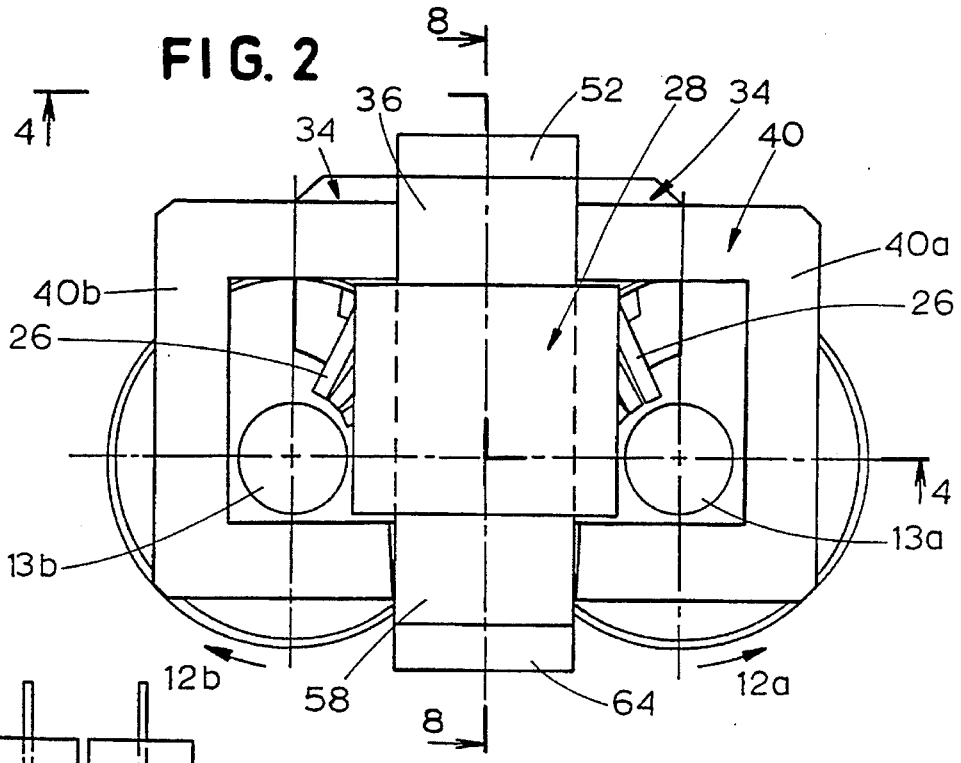
FIG. 1C
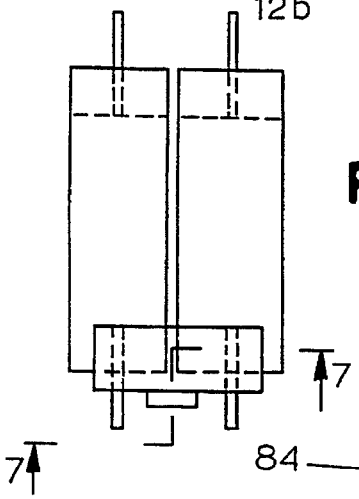
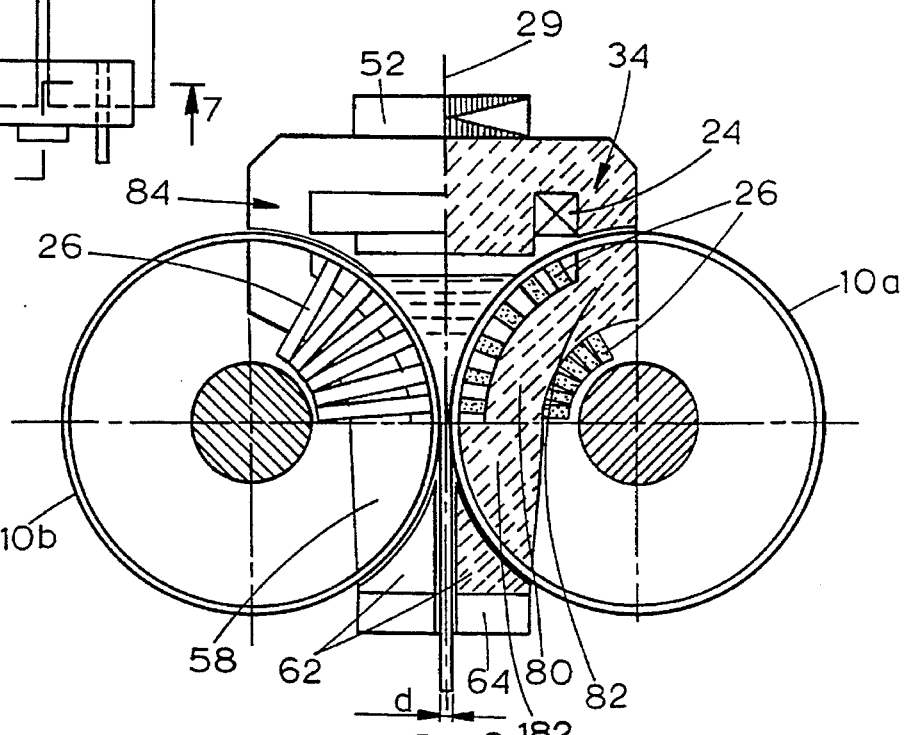
FIG. 3

APPARATUS AND METHOD FOR SIDEWALL CONTAINMENT OF MOLTEN METAL WITH VERTICAL MAGNETIC FIELDS

FIELD OF THE INVENTION

The present invention relates generally to apparatuses and methods for electromagnetically confining molten metal and, more particularly, to an apparatus and method for preventing the escape of molten metal through the open side of a vertically extending gap between two horizontally spaced members and within which the molten metal is located.

BACKGROUND OF THE INVENTION AND PRIOR ART

An example of an environment in which the present invention is intended to operate is an arrangement for continuously casting molten metal directly into strip, e.g., steel strip. Such an apparatus typically comprises a pair of horizontally spaced rollers mounted for rotation in opposite rotational senses about respective horizontal axes. The two rollers define a horizontally disposed, vertically extending gap therebetween for receiving the molten metal. The gap defined by the rollers tapers in a downward direction. The rollers are cooled, and in turn cool the molten metal as the molten metal descends through the gap.

The gap has horizontally spaced, open opposite ends adjacent the ends of the two rollers. The molten metal is unconfined by the rollers at the open ends of the gap. To prevent molten metal from escaping outwardly through the open ends of the gap, mechanical dams or seals have been employed.

Mechanical dams have drawbacks because the dam is in physical contact with both the rotating rollers and the molten metal. As a result, the dam is subject to wear, leaking and breakage and can cause freezing and large thermal gradients in the molten metal. Moreover, contact between the mechanical dam and the solidifying metal can cause irregularities along the edges of metal strip cast in this manner, thereby offsetting the advantages of continuous casting over the conventional method of rolling metal strip from a thicker, solid entity.

The advantages obtained from the continuous casting of metal strip, and the disadvantages arising from the use of mechanical dams or seals are described in more detail in Praeg U.S. Pat. No. 4,936,374 in Lari, et al. U.S. Pat. No. 4,974,661, in Gerber, et al. U.S. Pat. No. 5,197,534, and in Praeg U.S. Pat. No. 5,251,685, each of which is hereby incorporated by reference.

To overcome the disadvantages inherent in the employment of mechanical dams or seals, efforts have been made to contain the molten metal at the open end of the gap between the rollers by employing an electromagnet having a core encircled by a conductive coil, through which an alternating electric current flows, and having a pair of magnet poles located adjacent the open end of the gap. The magnet is energized by the flow of alternating current through the coil, and the magnet generates an alternating magnetic field, extending across the open end of the gap, between the poles of the magnet. The magnetic field can be either horizontally disposed or vertically disposed, depending upon the disposition of the poles of the magnet. Examples of magnets which produce a horizontal field are described in the aforementioned praeg U.S. Pat. Nos. 4,936,374 and 5,251,685, and Gerber, et al. U.S. Pat. No. 5,197,534; and examples of magnets which produce a vertical magnetic field are described in the aforementioned Lari, et al. U.S. Pat. No. 4,974,661. The alternating magnetic field induces eddy currents in the molten metal adjacent the open end of the gap, creating a repulsive force which urges the molten metal away from the open end of the gap.

The static pressure force urging the molten metal outwardly through the open end of the gap between the rollers increases with increased depth of the molten metal, and the magnetic pressure exerted by the magnetic field must be sufficient to counter the maximum outward pressure exerted by the molten metal. A more detailed discussion of the considerations described in the preceding sentence and of the various parameters involved in those considerations are contained in the aforementioned two Praeg, Gerber, et al. and Lari, et al. U.S. Patents. As disclosed in the Praeg and Lari, et al. patents, non-magnetic, electrically conductive heat shields can be disposed between the molten metal sidewall and the magnetic poles at the open side of the gap to protect the electromagnet coil from excessive heat and to shape the magnetic flux density.

The maximum magnetic pressure $P_{max}$ exerted on the molten metal sidewall at the open end of the gap between the rollers by the electromagnet should be at least equal to the full static pressure head of the molten metal (melt) contained between the rollers:

$$P_{max}=\rho gh \tag{1}$$

where $\rho$ is the liquid metal density;

g is the acceleration due to gravity; and h is the depth of the melt pool from the upper melt level to the end of the solidification point, at the nip.

The magnetic pressure P is related to the electromagnetic force, $\vec{f}$, which is the product of the induced current $\vec{j}$ and magnetic induction or flux density $\vec{B}$:

$$\vec{f}=\vec{j}\times\vec{B} \tag{2}$$

In one embodiment employing horizontally disposed electromagnetic fields, the prior art achieves magnetic confinement of the sidewall of molten metal at the open end of the gap by providing a low reluctance flux path near the end of each roller (the rim portion of the rollers). The apparatus of the prior art comprises an electromagnet for generating an alternating magnetic field that is applied, via the low reluctance rim portions of the rollers, to the sidewall of the molten metal contained by the rollers. For efficient application of the magnetic field, each magnet pole must extend axially, relative to the rollers, very close to the end of a respective roller to be next to the low reluctance rim portion of the roller and separated from this rim portion by only a small radial air gap. For efficient operation, the low reluctance flux path in the rim portion of a roller usually is formed from highly permeable magnetic material.

Another expedient for horizontal containment of molten metal at the open end of a gap between a pair of members, e.g., rollers, is to locate, adjacent the open end of the gap, a coil through which an alternating current flows. This causes the coil to generate a magnetic field which induces eddy currents in the molten metal adjacent the open end of the gap resulting in a repulsive force similar to that described above in connection with the magnetic field generated by an electromagnet. Embodiments of this type of expedient are described in Olsson U.S. Pat. No. 4,020,890, and Gerber U.S. Pat. No. 5,197,534, hereby incorporated by reference.

SUMMARY OF THE INVENTION

The drawbacks and deficiencies of the prior art expedients described above are eliminated by an apparatus and method in accordance with the present invention.

A magnetic confining method and apparatus in accordance with the present invention generates, adjacent the open side of the roller gap, a primary vertical magnetic field (a) resulting from direct current (D.C.) or alternating current (A.C.) flowing through a primary coil surrounding a core of a primary electromagnet and/or (b) resulting from D.C. or A.C. current flowing through stabilizer coils surrounding a different core portion of the primary electromagnet. There is one or more additional vertical magnetic fields, generated by one or more additional coils or induced current paths that serve to concentrate and shape the primary magnetic field. Both the primary vertical field and one or more additional or secondary vertical magnetic fields extend through the open end of the gap to the molten metal in the gap. The combination of magnetic fields and corresponding induced horizontal currents generated in accordance with the present invention cooperate to provide sufficient electromagnetic force over the depth of the molten metal, at the sidewall of molten metal, to provide containment of the molten metal in the vertical gap between the rollers. The magnetic fields, in combination, are sufficient to electromagnetically confine and stabilize the molten metal within the gap between the rollers.

As will be explained in more detail hereinafter, the apparatuses and methods of the present invention operate substantially differently in each of two different embodiments—a direct current (D.C.) embodiment and an alternating current (A.C.) embodiment—wherein the primary vertical magnetic field is formed from direct current or alternating current passing through primary coils of a primary electromagnet. For the purpose of clarity in understanding, therefore, each embodiment (D.C. and A.C.) will be described separately.

In accordance with the D.C. embodiment of the present invention, a primary vertical magnetic field is generated by a D.C. primary coil surrounding a magnetic core portion of a D.C. primary electromagnet, and the core portion includes a pair of vertically spaced magnet poles having opposed, spaced pole faces located adjacent the open side of the gap. Mutually facing surface portions of the magnet poles are disposed near the open side of the gap. In the D.C. embodiment, direct current is conducted through the D.C. primary coil to generate the primary D.C. vertical magnetic field between the pole faces. The field extends between the facing surfaces of the magnet poles; it is vertically adjacent to the open end of the gap, and extends into the molten metal. In addition to this primary D.C. vertical magnetic field in the gap, additional vertical magnetic fields, generated from other coils, also are provided in the gap. The combined effect of these fields generate eddy currents in the liquid metal, at the edge, and allow for the full face containment of the liquid metal pool, at the edge, as well as providing the means to concentrate and shape the magnetic force at the edge, and stabilize the molten metal pool.

The magnetic concentrating means comprises (a) the rollers themselves, for example, having copper sleeves that force the magnetic field toward the molten metal sidewall by virtue of their shape; and/or (b) one or more secondary coils that induce an alternating current in the liquid metal pool at the confined edge. This induced current can be rectified by a diode, connected between the roller shafts, and flows through the molten metal sidewall and across the roller sleeves.

In this way, in the D.C. embodiment, the secondary (stabilizing) vertical magnetic field that is produced by secondary A.C. coils located adjacent to the liquid pool at the open gap, generates a half-period, rectified, induced horizontal current $I_2$ that flows between the roller axes through a diode disposed in a conductor connecting the roller axes to provide a complete current loop through both axes and across the roller ends and the molten metal pool at the sidewall. In this D.C. embodiment, and as explained in more detail hereinafter in the detailed description of the A.C. embodiment, the induced alternating current flows through the roller sleeves and through the molten metal sidewalls to provide a complete current path. The secondary magnetic field in the D.C. embodiment extends primarily vertically into the molten metal-containing gap and into the molten metal there, and cooperates with the primary vertical magnetic field to concentrate, and/or shape the primary vertical magnetic field, and to stabilize the liquid metal pool.

The primary field also can be concentrated by one or more secondary vertical magnetic fields generated by additional secondary coils located within hollowed ends of the rollers, as described in more detail hereinafter, wherein the rollers and/or roller coils concentrate and/or shape the vertical magnetic field primarily toward the molten metal sidewall, within the gap, between and above the outer edges of the rollers, against the sidewall. These additional secondary coils surround a magnetic core, disposed within hollowed end portions of the rollers, adjacent the end of the gap. These additional secondary coils can be powered by a D.C. source or a low frequency, e.g., 1–60 Hz, A.C. source. Since the magnetic fields generated by these coils pass through the hollowed roller portions, proximate to the gap, the frequency of the alternating electric current flowing through these roller-contained coils can be chosen to be within different and optimal frequency ranges. The selection of the frequency should be selected to satisfy the primary objectives (a) to optimize field penetration of the plurality of vertical magnetic fields into the sidewall of the pool of molten metal and in the rims and sidewalls of the rollers; and (b) to minimize eddy current heating of these roller rims and roller sidewalls.

In accordance with the A.C. embodiment of the present invention, one electromagnet comprises coil windings within a ferromagnetic body portion disposed along the length of the rollers themselves, electrically insulated from outer copper roller sleeves. The primary electromagnet of the A.C. embodiment may be these coil windings within the rollers, or the same primary electromagnet of the D.C. embodiment, but powered by an alternating current source. In either case, one of these electromagnets concentrates and shapes the vertical magnetic field produced by the other electromagnet. Alternating current passing through the coil windings in the roller body portion induces a horizontal current through the molten metal and copper roller sleeves, over the length of the roller sleeves in contact with molten metal, and the induced horizontal current then passes across the molten metal sidewall, to provide a corresponding A.C. vertical magnetic field located at the free sidewall of the molten metal.

In the A.C. embodiment, enhancement, concentration and shaping of the primary A.C. vertical magnetic field is achieved by (1) the incorporation of capacitors into the electrical circuit of coil windings within the rollers to provide a resonant oscillatory RLC circuit; and/or (2) a secondary A.C. coil—that may be the primary D.C. coil of the D.C. embodiment, but supplied with alternating current; and/or (3) the stabilizing coil of the D.C. embodiment, disposed adjacent the sidewall of the molten metal, and supplied with alternating current.

Any one or more of these secondary sources of an A.C. vertical magnetic field serves to concentrate and shape the primary vertical A.C. magnetic field at the molten metal sidewall. The A.C. vertical magnetic fields combine and are forced, concentrated and shaped into the sidewall of the molten metal to provide sidewall stability, and sufficient magnetic force to prevent molten metal from leaking out of the open end of the roller gap.

In accordance with an important feature of both embodiments of the present invention, one or more electrical circuits (a) disposed adjacent the molten metal sidewall, or (b) disposed within ferromagnetic body portions of the rollers, induce horizontal currents (1) through shafts of the rollers and through the edge of the molten metal sidewalls or (2) across copper roller sleeves over the length of the rollers in contact with molten metal, and then through the molten metal sidewall. The electromagnetic circuit(s) of both embodiments provide vertical magnetic fields that exert concentrating and/or field shaping magnetic pressure against the molten metal sidewall. The combination of magnetic fields provides concentrated and shaped magnetic pressure in a direction generally restricted toward the open end of the gap and the molten metal there, without substantial dissipation of the magnetic field in a direction away from the open end of the gap.

Accordingly, one aspect of the present invention is to provide an apparatus for and method of generating a plurality of cooperating vertical magnetic fields, adjacent an open end of a gap between two spaced members, e.g., rollers. The fields extend into the gap, to the molten metal in the gap, to confine the molten metal between the spaced members, without mechanical seals at the gap.

Another aspect of the present invention is to provide an electromagnetic molten metal confining apparatus and method wherein a primary vertical magnetic field is produced via direct or alternating electric current flowing through primary magnetic coil windings, which may be different for the D.C. and A.C. embodiments. The flux density of the primary vertical magnetic field is concentrated and shaped within the space of the gap between the rollers by including a cooperating vertical magnetic field through the free edge of the molten metal. The cooperating field is operatively associated with (a) a rectified, induced A.C. current flowing horizontally through roller rims, roller shafts and the sidewall of the molten metal (D.C. embodiment), or (b) an A.C. current flowing through the primary coil windings in ferromagnetic portions of the rollers, which induces a horizontal current in copper roller sleeves, through the molten metal sidewall (A.C. embodiment), and through capacitors incorporated within the electrical circuit.

Another aspect of the present invention is to provide an electromagnetic apparatus and method for confinement of molten metal within a gap between two rollers wherein the electromagnetic apparatus and method can operate in a primarily D.C. mode or an A.C. mode, and wherein alternating current can be supplied at different frequencies to different coil sections in both modes of operation.

Still another aspect of the present invention is to provide a direct current electromagnetic apparatus and method for molten metal confinement utilizing D.C. and rectified A.C. current through spaced coils of a primary and a secondary electromagnet. An A.C.—produced horizontal current in secondary coils induces a horizontal current, in a secondary electric circuit, that is rectified into D.C. current. By varying the frequency of the alternating current in the secondary electric circuit, the total electromagnetic pressure $P_m$ applied to the molten metal can be uniquely controlled in response to one or more sensed circuit parameters, such as inductance.

Yet another aspect of the present invention is to provide an electromagnetic apparatus and method for molten metal confinement utilizing alternating electric current flowing (a) through coils of one electromagnet, including coil windings disposed within a ferromagnetic body portion of a roller to produce an A.C. vertical magnetic field and (b) through one or more second coils disposed adjacent to the molten metal sidewall. The A.C. current flowing through the coil windings within the rollers provides an A.C. vertical magnetic field, and, by incorporating capacitors into the electric circuit that includes the roller windings and the roller shafts to optimize the current, and by placing the windings in the rollers, the A.C. vertical magnetic field is controlled and shaped at the molten metal sidewall.

Another aspect of the present invention is to provide a tertiary A.C. or D.C. vertical magnetic field from an electromagnet having a proximity effect coil adjacent the free edge of molten metal. The proximity effect coil is disposed closely adjacent to the end of the roller gap containing molten metal, wherein a surface of said proximity effect coil that faces the molten metal is blackened to absorb heat radiated from the molten metal pool (Joule heat resulting from Eddy currents flowing through the free edge of the molten metal).

Another aspect of the present invention is to provide an apparatus and method for molten metal confinement between two spaced rollers, wherein the rollers include internal windings that receive A.C. current. The windings are electrically insulated from exterior, non-ferromagnetic, e.g., copper, roller sleeves. The current that flows through the roller windings produces an induced horizontal A.C. current through the roller sleeves, that flows across the free edges of the molten metal to the opposite roller sleeve. The interaction between the vertical magnetic fields provide a concentrated, vertical electromagnetic field at the free edge of the molten metal.

Other features and advantages are inherent in the method and apparatus of the present invention or will become apparent to those skilled in the art from the following detailed description taken in conjunction with the accompanying drawings.

BRIEF DESCRIPTION OF THE DRAWINGS

FIG. 1C is a top view of the apparatus of FIG. 1A showing the cross-section lines 7—7;

FIG. 2 is an end view of the apparatus and rollers of FIG. 1A;

FIG. 3 is a cross-sectional view taken along the line 3—3 of FIG. 1B;

DETAILED DESCRIPTION OF THE PREFERRED EMBODIMENTS

Figures 1A, 1B:
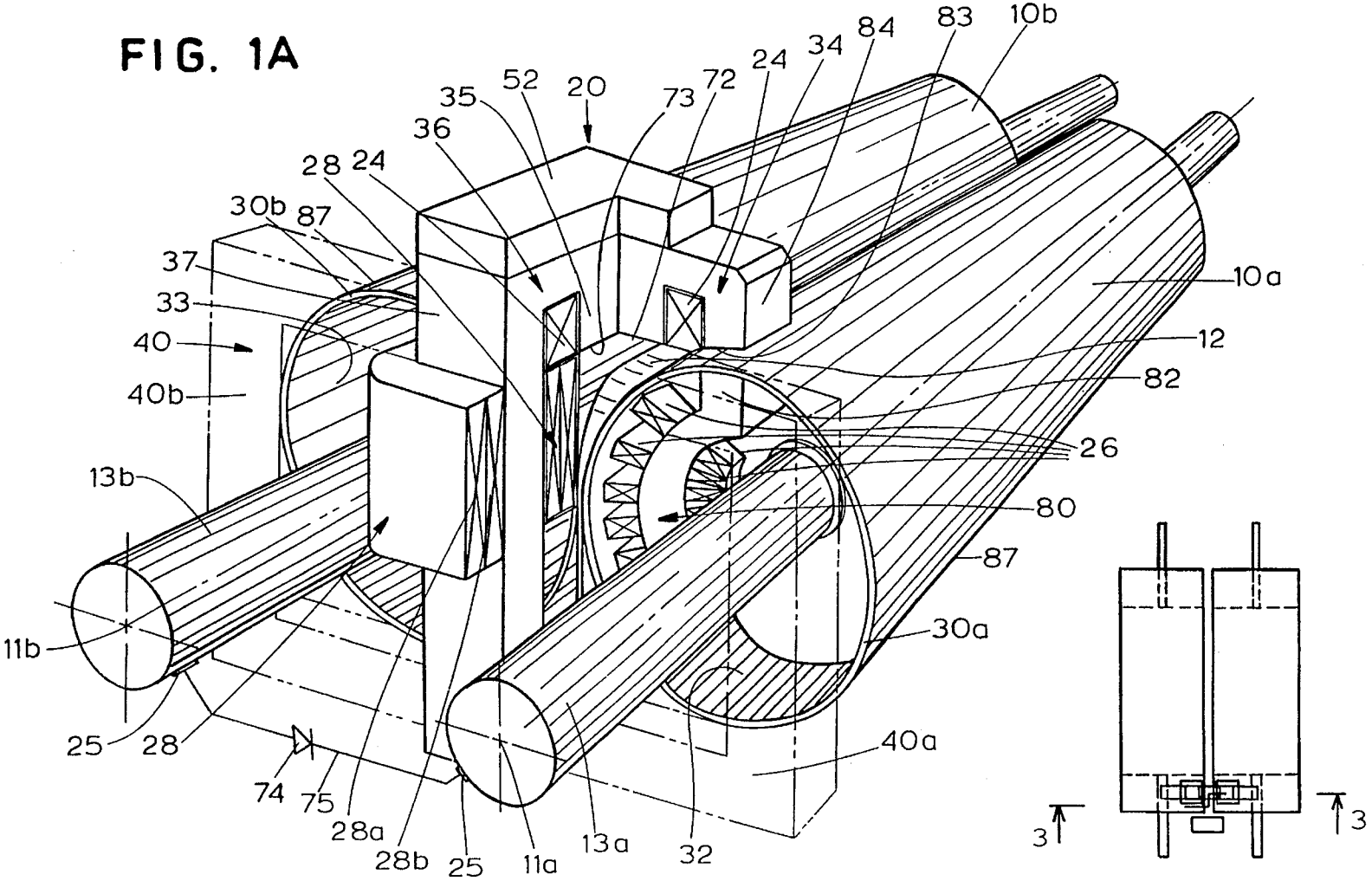
FIG. 1A is a partially broken-away perspective view showing a D.C. embodiment of an electromagnetic molten metal sidewall containment apparatus in accordance with the present invention, associated with a pair of rollers of a continuous strip caster.
FIG. 1B is a top view of the apparatus of FIG. 1A showing the cross-section lines 3—3.

Referring to the drawings, and initially to FIGS. 1–6, there is shown a D.C. embodiment of the magnetic confinement apparatus and method of the present invention associated with a pair of rollers of a continuous strip caster. It should be understood that while this specification will describe molten metal confinement at one end of a pair of rollers, there is confinement of molten metal between a pair of counter-rotating rollers at both ends of the pair of rollers.

As shown in FIG. 1A, a pair of rollers 10*a* and 10*b* (referred to collectively as rollers 10) are parallel and adjacent to each other and include roller shafts 13*a* and 13*b* having axes 11*a* and 11*b* that lie in a horizontal plane. Molten metal 12, in a pool of height "h" (FIG. 11), is contained between the rollers 10, above a point where the rollers are closest together (the nip). Rollers 10 are separated by a gap having a dimension "d" at the nip (FIG. 3). Counter rotation of rollers 10*a* and 10*b* (in the direction shown by the arrows 12*a* and 12*b* (FIG. 2), and gravity, force molten metal 12 to flow downwardly. The metal solidifies on each roller surface forming two thin shell portions by the time the metal leaves the gap at the nip between rollers 10. The two solidified shell portions will be joined at or near the narrowest gap (nip), having a thickness "d", between the rollers. A liquid core contained between the converging, solidified shells, from the upper molten metal level, to the nip (point where rollers are closest together), exerts a head pressure which is linearly proportional to the molten metal pool depth "h".

Rollers 10 are made of a material having a suitable thermal conductivity, for example, copper or a copper-based alloy, stainless steel, and the like, and are water cooled internally, as will be described in more detail hereinafter.

Referring now specifically to FIGS. 1–4, a primary D.C. electromagnet 20 includes a ferromagnetic, e.g., iron, core, and a plurality of independently operable coils. The coils associated with electromagnet 20 comprise primary D.C. coils 24, and stabilizer coils 28. Current from separate power supplies flows through coils 24 and 28 to provide a vertical magnetic field across the molten metal sidewall that is sufficient for containment, and stabilization of the sidewall. In the preferred D.C. embodiment, a second electromagnet, including a third set of coils 26 (FIGS. 1 and 3), disposed within the ends of the rollers, provide concentration and shaping of the field from primary D.C. electromagnet 20. The three distinct vertical magnetic fields are concentrated and stabilized at the free edge of the molten metal (sidewall) between the rollers 10*a* and 10*b*, as will be explained in more detail hereinafter. Coils 26 are only used in the D.C. embodiment of the present invention.

The primary D.C. electromagnetic core is shown partially broken away in FIG. 1A to expose the coils 24 and 28. As best shown in FIGS. 1, 3 and 6, coil 24 is disposed above and between a top of rollers 10*a* and 10*b*. Coil 28 (FIGS. 1, 2, 4, 5 and 6) is disposed adjacent to and in front of a contained, roller-contacting side edge of the molten metal. Coil 26 (FIGS. 1–4) is disposed within hollowed end portions of rollers 10*a* and 10*b* and closely adjacent to an inner surface of copper sleeves—surrounding the rollers 10*a* and 10*b*, and including roller rims 30*a* and 30*b*. As shown in FIG. 1A, coil 26 is primarily within the hollowed end portion 32 of roller 10*a* above and adjacent to roller shaft 13*a*. It should be understood that another coil 26, identically configured to coil 26 shown in FIG. 1A, is disposed within a hollowed end portion 33 of roller 10*b*, corresponding to hollowed end portion 32 in roller 10*a*. Coil 26 can be formed from a plurality of separate coils, each connected to an independent power source, following the contour of core 80, shown in FIGS. 1–4. As shown in FIGS. 1–4, the coils 26 are closer to the central, vertical plane 29 (FIG. 3) of the molten metal that passes through the nip than coils 26 at the upper surface of the molten metal. The magnetic pressure, therefore, will be stronger near the nip where the greatest molten metal depth requires the most confining pressure. Similarly, if desired, coils 26 that are disposed closer to the nip can be connected to a separate power source to provide a stronger vertical magnetic field near the bottom of the molten metal pool than at the upper surface of the molten metal pool.

The primary D.C. electromagnet 20, best shown in FIGS. 1–6, includes the two coils 24 and 28, each surrounding different portions of the central magnetic core. The magnetic core is formed from a ferromagnetic metal, e.g., iron, and is formed from integrally connected core sections, the main parts of which are generally designated by reference numerals 34 and 36. Magnetic core section 34 is generally E-shaped having the three legs of the "E" extending downwardly, with outer legs overlying the rollers and a central leg disposed over the pool of molten metal 12. Core section 34 is disposed above the pool of molten metal 12, spanning both rollers 10*a* and 10*b*, above the hollowed end portions 32 and 33 of rollers 10*a* and 10*b*. Core section 34 is disposed transverse to, between and above roller axes 11*a* and 11*b* with outermost edges of the outer legs of the E-shaped coil section 34 disposed at about the highest circumferential point of the rollers 10*a* and 10*b*.

Magnetic core section 36 is generally C-shaped and connected transversely to the E-shaped core section 34 at its center leg, such that only an upper leg portion 35 of the C-shaped core section 36 connects to the central leg of the E-shaped core section 34. Coil 24 extends through both gaps between the downwardly extending legs of the E-shaped core 34 and around the connecting upper leg portion 35 of C-shaped core section 36. Coil 24 extends between a downwardly extending base portion 37 of core section 36, and the connecting leg portion 35 of core section 36. Stabilizing coil 28 centrally surrounds the base portion 37 of core section 36, adjacent to, and having inner turns facing the sidewall being confined. Stabilizing coil 28 is disposed vertically under the portion of coil 24 that passes adjacent the C-shaped core leg portion 35. A generally U-shaped yoke 40 is disposed to circumscribe the roller shafts 13*a* and 13*b* and magnetically connects magnetic core section 34, via upper core portion 52 and lower core portion 60, to a pair of lower electromagnet poles 62, having upwardly facing pole faces 66, disposed under the molten metal 12 at the confined sidewall. The shafts 13*a* and 13*b* are disposed near the base of, and within the interior of, U-shaped yoke 40, as best shown in FIG. 2.

E-shaped core section 34, best shown in FIG. 6, is integrally connected to the yoke 40, at upper and lower arms 40*a* and 40*b*. A generally L-shaped, ferromagnetic structure 57 (FIG. 6), including a vertical support bar 58, extending perpendicularly upwardly from a horizontal lower leg portion 60, magnetically interconnects to the upper portion of the primary electromagnet 20 via the yoke 40. Lower leg portion 60 of L-shaped structure 57 includes the pair of spaced, lower electromagnet poles 62 extending vertically upwardly from an end 64 of leg portion 60. The lower poles 62 include upwardly facing, lower electromagnet pole faces 66, mounted to leg portion 60, extending the pole faces upwardly adjacent to the roller gap.

E-shaped core section 34 includes a lowermost core wall 72, formed by a lowermost wall of the center leg of the E-shaped core section 34, that serves as an upper electromagnet pole face. Pole face 72 is aligned vertically above and spaced from the lower electromagnet pole faces 66 (see FIGS. 1 and 6), with the melt edge disposed therebetween. C-shaped core section 36 includes an upper electromagnet pole face 73 formed by a lower wall of the leg portion 35. Upper electromagnet pole faces 72 and 73 are disposed in a common horizontal plane, vertically spaced from lower pole faces 66. Upper pole face 72 is disposed above the molten metal sidewall, with the sidewall disposed vertically between pole faces 72 and 66. Upper pole face 73 is disposed above the molten metal sidewall, and horizontally spaced in front of the sidewall, so that the vertical field established between pole faces 73 and 66 stabilizes the molten metal sidewall. Preferably, upper pole faces 72 and 73 are disposed above the upper level of the molten metal and a portion of lower pole face 66 is disposed just below the nip so that the vertical magnetic field between the pole faces 72, 73 and 66 are aligned with, as well as in front of the molten metal sidewall to be contained.

Figure 4:
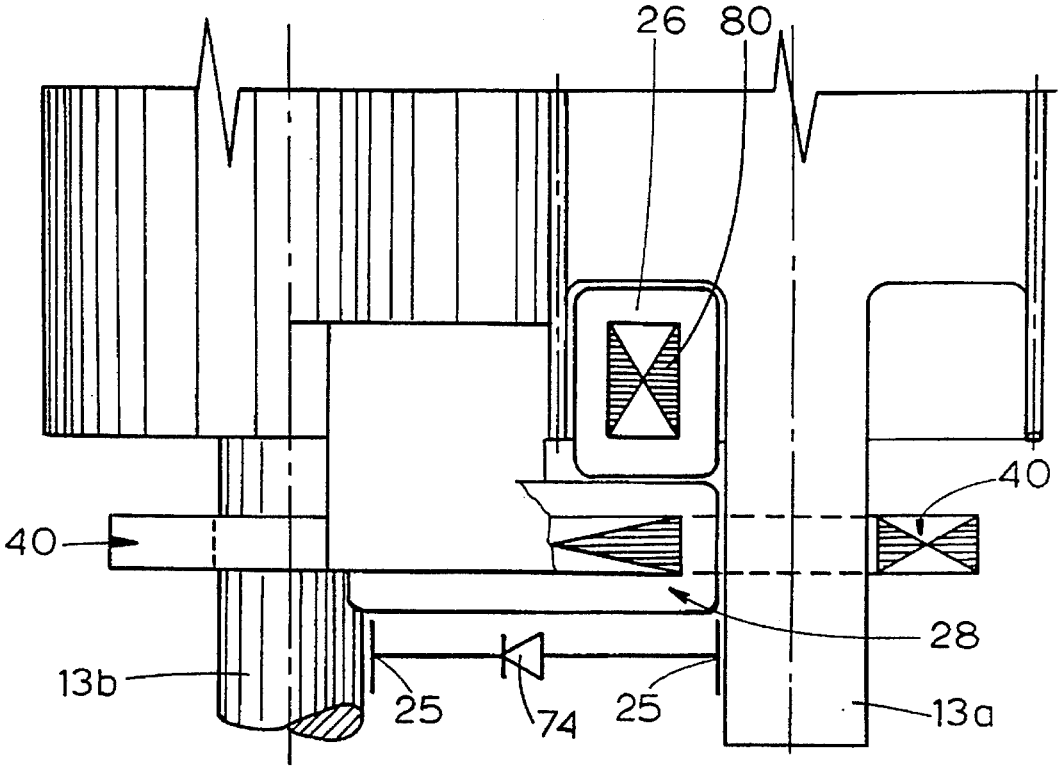
FIG. 4 is a fragmentary top view, partially broken-away, of a portion of the apparatus, taken along line 4—4 of FIG. 2.

Secondary D.C. coils 26 are mounted within the hollowed end portions 32 and 33 of rollers 10*a* and 10*b* to surround a separate C-shaped core finger portion generally designated 80 (FIGS. 1, 4, and 6). Core finger portion 80 includes an integral, vertical core portion 82 in vertical alignment with a lowermost end wall 83 of one of the outer fingers 84 of the E-shaped core portion 34, disposed above roller 10*a*. An identical C-shaped core finger portion 80 having an identical, integral upstanding vertical core portion 82, surrounded by identical coils 26, also is provided within the hollowed end portion 33 of roller 10*b*. At the opposite end, core finger portions 80 include integral lower core portions 182 (FIG. 3) in alignment with magnetic poles 62, completing a magnetic circuit that includes core portions 57, 58, 36 and 34.

The apparatus described above and shown in FIGS. 1–6 operates in accordance with a direct current (D.C.) embodiment of the present invention to provide a concentration of the magnetic flux density at the sidewall being contained, within the areas of the roller edges and the gap between the rollers 10*a* and 10*b*, and to stabilize the molten metal at the sidewall. In accordance with this D.C. embodiment of the apparatus and method of the present invention, primary D.C. coil 24 is energized by direct current supplied from a direct current power source (not shown) to provide a vertical magnetic field extending between upper electromagnet pole faces 72 and 73, and lower electromagnet pole faces 66, adjacent to and surrounding the molten metal sidewall.

In accordance with an important feature of this D.C. embodiment of the apparatus and method of the present invention, this primary D.C. vertical magnetic field is concentrated and shaped in the area of the roller edges and sidewall by a secondary vertical magnetic field that is produced by current supplied through secondary coils 26, connected to a separate power supply. The molten metal pool contained by the two magnetic fields is stabilized by the vertical magnetic fields produced as a result of a current-controlled field provided by the proximity effect of supplying at least an outer (molten metal-adjacent) section 28*a* of stabilizer coils 28 with a source of alternating current, as will be explained in more detail hereinafter. An inner section 28*b* of the stabilizer coil 28 simultaneously can be supplied with direct or low frequency current to further enhance the effects of the primary field at the sidewall.

It should be understood that coil 28 is divided into two adjacent sections 28*a* and 28*b*, as shown in FIG. 1A, but is not shown as such in all figures for simplicity and clarity in showing current and magnetic field paths in other views.

Figure 5:
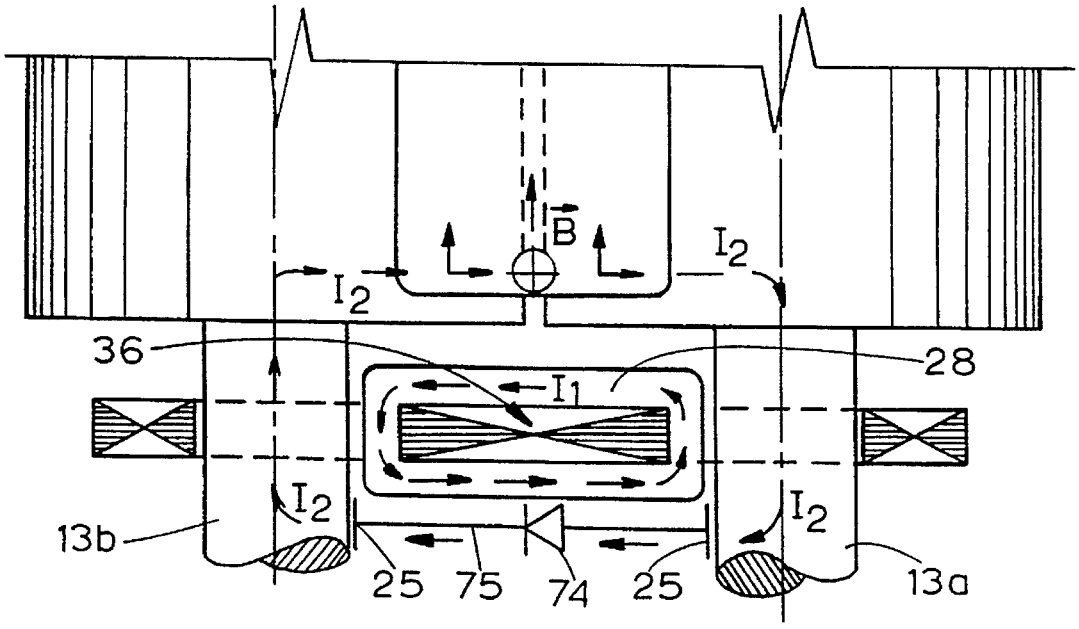
FIG. 5 is a schematic representation of a portion of the apparatus of FIG. 4 showing primary ($I_1$) and secondary ($I_2$) current loops of stabilizing coils 28.
Figure 6:
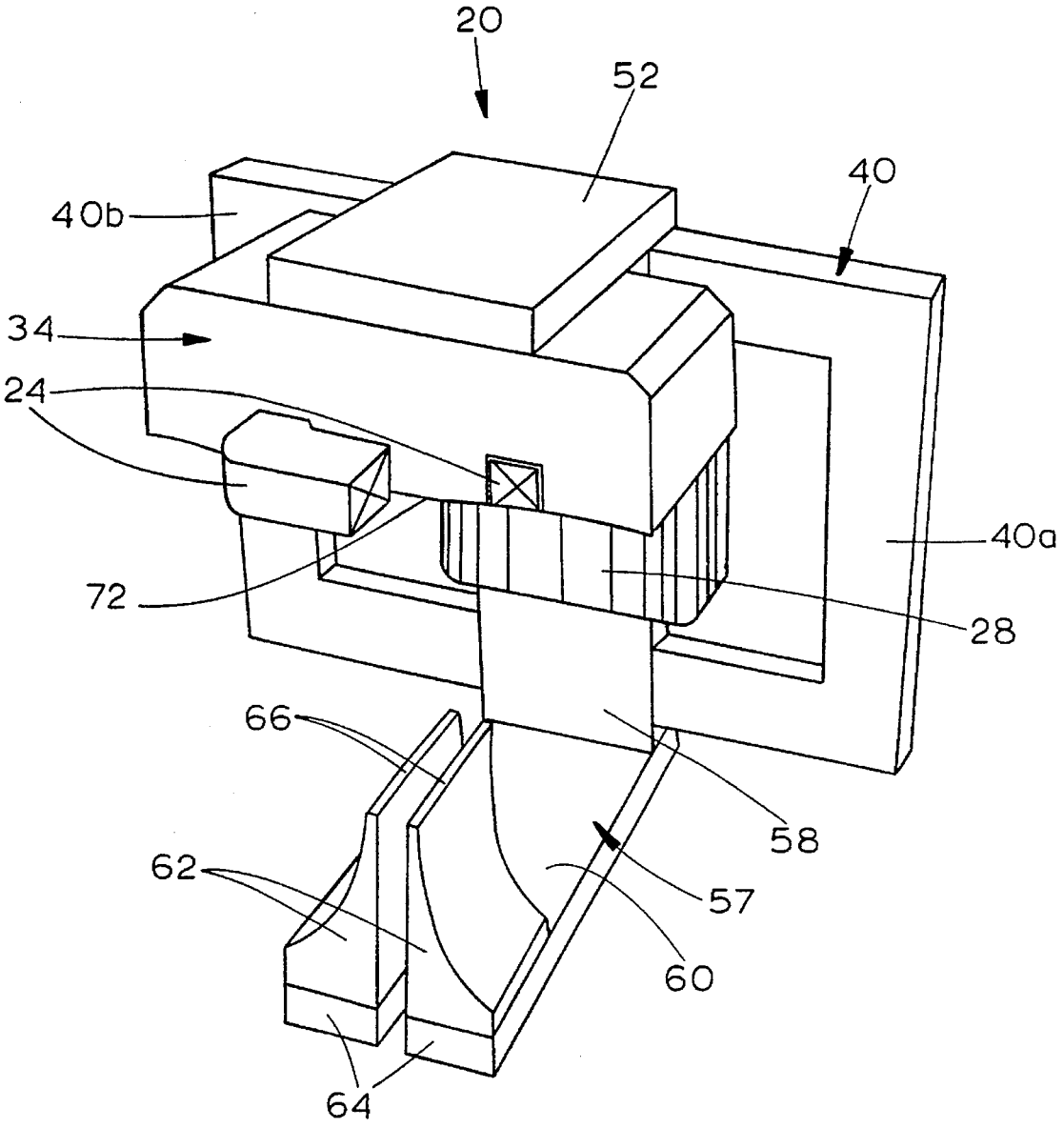
FIG. 6 is a perspective view of the primary coil 24, stabilizing coils 28, and the central core portion of the apparatus of FIG. 1A.
Figure 7:
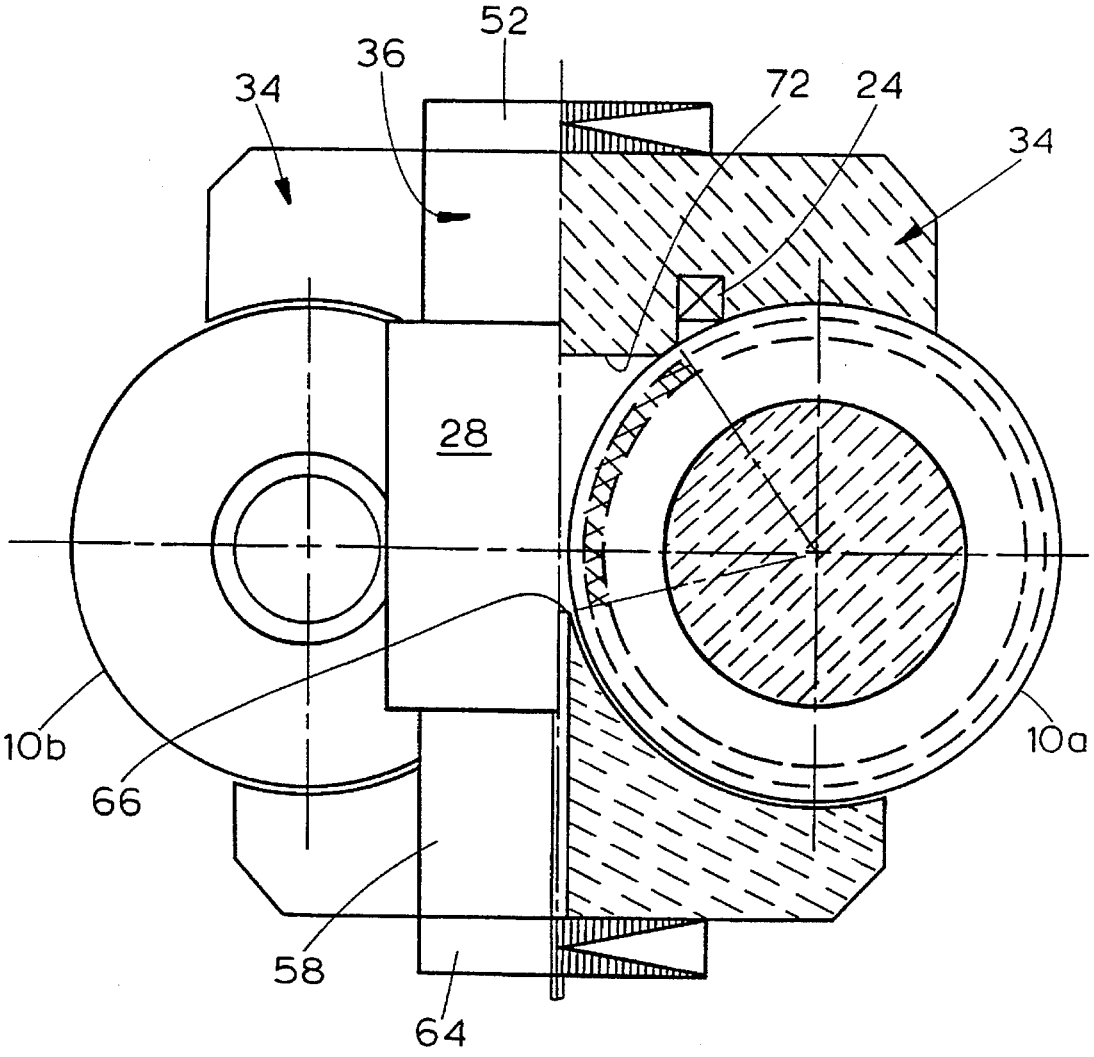
FIG. 7 is a vertical cross-sectional view of a portion of the apparatus used in an A.C. vertical magnetic field embodiment of the present invention taken along the line 7—7 of FIG. 1C.

In accordance with this D.C. embodiment of the present invention, alternating current ($I_1$) is supplied to at least an external (melt adjacent) section 28*a* of the coils 28, as shown in FIG. 5. The alternating current $I_1$ flowing through the external section 28*a* of coils 28 induces a current $I_2$ through roller shaft 13*a* and through a conductor 75 and semiconductor rectifier 74, electrically interconnected to the other roller shaft 13*b*. As best shown in FIG. 5, from roller shaft 13*b*, the induced current $I_2$ flows through the roller body, the roller sleeve, and then through the molten metal sidewall, back to roller shaft 13*a* to form a closed electrical circuit with the rollers 10*a* and 10*b* and the molten metal 12. The closed circuit (FIGS. 1 and 5) is completed through sliding contacts 25, slidingly contacting the outer surfaces of the roller shafts 13*a* and 13*b*. Direct current can be supplied to the internal section 28*b* of coils 28 to provide additional concentration of the vertical field extending between the opposed pole faces 72, 73 and 66 in the same manner as the vertical field produced by energizing primary D.C. coils 24. Alternatively, a low frequency alternating current, e.g., 1–60 $H_z$, can be used in coil 28*b* to achieve a similar effect.

Figure 12A:
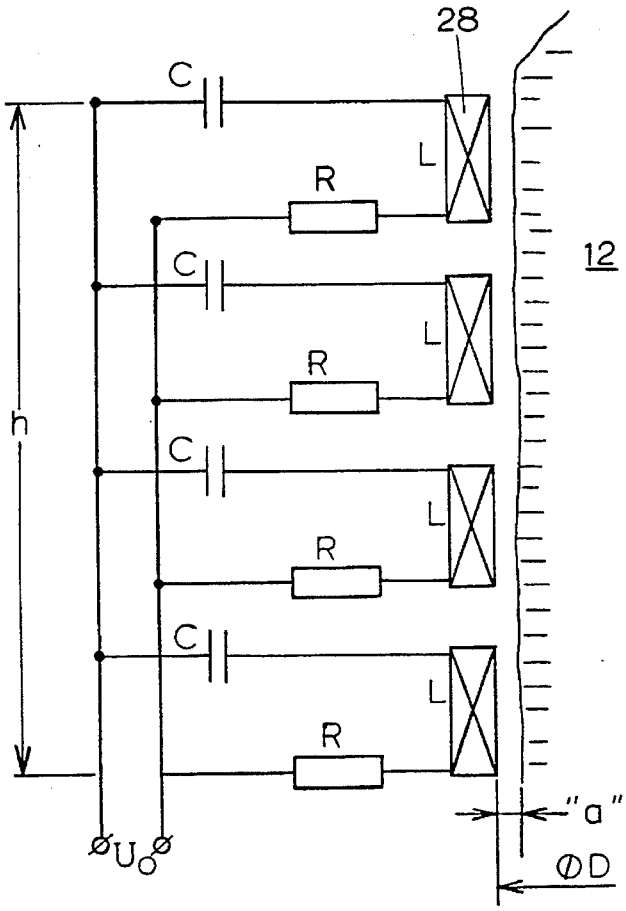
FIG. 12 is a schematic (FIG. 12A) of an oscillatory RLC circuit and a related graph (FIG. 12B) showing the operation of the stabilizing coils 28.
Figure 12B:
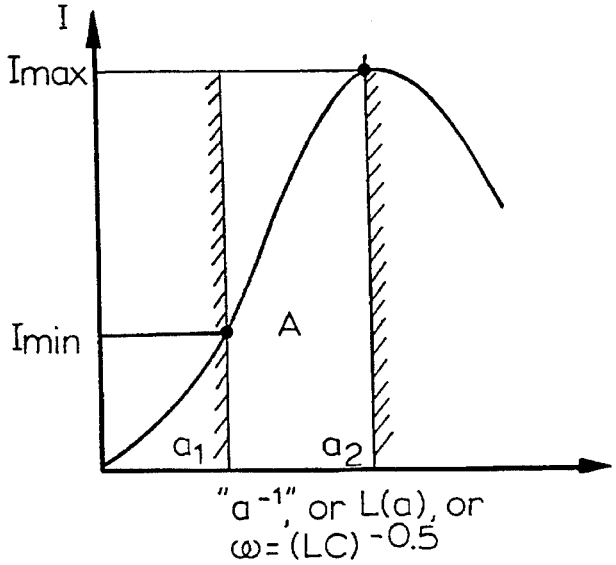

If a gap "a" between the molten metal sidewall and the adjacent coil 28 decreases, the inductance L of coil 28 changes and the current through coil 28 increases, which in turn increases the size of the gap "a", as shown in FIG. 12. As a result, if molten metal approaches the adjacent coil section 28*a*, e.g., due to molten metal instability, resonance is approached as a result of the change in mutual inductance. This inductance change increases the current within coil 28, thus providing an automatic flux density increase at the molten metal sidewall, and thereby increasing the gap "a", reducing the tendency of the molten metal to move.

In accordance with this D.C. method of molten metal containment, the magnetic pressure $P_m$ applied to the sidewall free surface of the molten metal is produced by an interaction of (a) the vertically directed D.C. magnetic field B(y) produced by energizing primary D.C. coils 24 and secondary D.C. or A.C. coils 26, with the field(s) generated by the current $I_2$ horizontally directed within the molten metal edge, and which is a result of alternating current supplied to the melt adjacent section 28*a* and/or inner section 28*b* of coils 28, in accordance with the following equation (3):

$$P_m = \phi \int_{o}^{Z_0} j_x \cdot B(y) \cdot dz \tag{3}$$

where:

$Z_0$ is the distance in the axial direction of the rollers at which an interaction of the magnetic field B(y) and current $I_2$ occurs. Typical levels for the current density and magnetic induction for this D.C. method are about 1.5 to about 3.0 A/mm$^2$ and not less than about 0.7 T, respectively.

The electromagnetic force, $\vec{f}$, also is distributed in the roller axial direction from the edge of the melt, to a certain distance $Z_0$, where the melt is acted upon by both current and magnetic induction. The product of current and magnetic induction should satisfy the condition:

$$(\vec{j} \times \vec{B})_z = \frac{\rho \vec{g} h}{Z_0} \tag{4}$$

For example, magnetic induction or flux density B should be approximately 0.3 Tesla (T) if it is coupled with a current density of 2 A/mm$^2$ in a pool of liquid steel of 400 mm depth and axial roller working zone length $Z_0$ of 500 mm. For practical workability, however, due to magnetic field losses and other considerations, the magnetic flux density B should be at least equal to 0.7 T. Providing magnetic flux density at such a level within the space of a relatively large roller gap has proved to be a problem.

By varying the frequency of the alternating current supplied to the outer (melt-adjacent) coil section 28*a* within the range of 150 Hz to 5000 Hz, e.g., 600 Hz to 800 Hz, in the D.C. embodiment of this invention, the spatial range of interaction between the vertical field B(y) and due to the induced current within the melt, the position and stability of the liquid metal pool face, relative to the outer surface of coils 28, can be controlled. Consequently, the electromagnetic pressure $P_m$ is also being controlled in accordance with the equation:

$$P_m = \int_{0}^{Z} I_2 B(y)\, dz \tag{5}$$

This ability to control the distribution of induced current $I_2$ and, consequently, the magnetic force acting on the molten metal sidewall is a very important and unique advantage of the apparatus and method of the present invention.

In order to achieve the required containment of molten metal, the applied external electromagnetic field must be sufficient both to contain the molten metal above and between the rollers 10. However, the application of the above-mentioned magnetic fields could also generate a stirring motion within the molten metal. Therefore, the magnetic flux needed to contain the molten metal at the sidewall represents only a portion of the total magnetic flux required by the system. The amount of magnetic flux needed for containment and stirring are proportional to the coefficient $\phi$ in equation (3).

The coefficient $\phi$ is always less than 1, and, for example, $\phi$=0.76 is the theoretical calculation for the magnetic pressure $P_m$ adequate to magnetically support a typical liquid steel pool of 0.4 m depth, with $Z_0$=0.05 m, and with an induced current density (produced by $I_2$) of 2.0 A/mm$^2$ and a magnetic flux density of 0.7 T.

The vertical magnetic fields generated by the various power sources and the induced currents and their paths, in the various forms of the D.C. embodiment of the present invention, are shown in Tables I and II:

TABLE I

MAGNETIC FIELDS AND MAGNETIC FIELDS PATHS - D.C. EMBODIMENT

| Coil | Current through Coil | Core(s) (Single or Multiple Turn) | Function | Magnetic Fields | Magnetic Field Paths |
|---|---|---|---|---|---|
| 24 | $I_1$:D.C. | 34, 36 | primary vertical magnetic field | $B_1$ | Across "C" shaped core 36 across poles faces 73 and 66 |
| 28b | $I_2$:D.C., or A.C., e.g., 1–150 $H_z$ | 36, 58 | stabilizes melt pool | $B_2$ | Through "C"-shaped core 36 and across pole faces 73 and 66 |
| | | | | $B_2$ yoke | Through, and across spaces between, yoke portions 40a and 40b |
| 28a | $I_3$:A.C., e.g., 150–5000 $H_z$ | 36, 58 | shapes and/or concentrates primary vertical magnetic field and stabilizes melt pool | $B_3$ | Through "C"-shaped core 36 and across pole faces 73 and 66 |
| | | | | $B_3$ yoke | Through, and across spaces between, yoke portions 40a and 40b |
| 26 | $I_4$:D.C., or A.C., e.g., 1–150 $H_z$ | 34, 80 | shapes and/or concentrates primary vertical magnetic field | $B_4$ | Core 34 across upper pole faces 72 to lower pole faces 66, through lower poles 62, through core 80 through roller sleeve and back to core 34 |

TABLE II

| INDUCED CURRENTS AND CURRENT PATHS - D.C. EMBODIMENT | | | |
|---|---|---|---|
| Coil w/A.C. | Magnetic Field Generated | Induced Current Resulting From Magnetic Field | Path of Induced Current |
| If A.C. 28b | $B_2$; $B_2$ yoke | $J_2$, $J_2$ yoke | Positive Portion of A.C. Cycle: Through roller shaft 11b, rectifier 74 and conductor 75, roller shaft 11a, across sidewall of molten metal and back to roller shaft 11b Negative portion of A.C. Cycle: Axially across first roller sleeve, through molten metal sidewall, axially across opposite roller sleeve to a distance spaced from the sidewall, and across the molten metal pool to the first roller sleeve |
| If A.C. 28a | $B_3$, $B_3$ yoke | $J_3$, $J_3$ yoke | Positive Portion of A.C. Cycle: Through roller shaft 11b, rectifier 74 and conductor 75, roller shaft 11a, across sidewall of molten metal and back to roller shaft 11b Negative portion of A.C. Cycle: Axially across first roller sleeve, through molten metal sidewall, axially across opposite roller sleeve to a distance spaced from the sidewall, and across the molten metal pool to the first roller sleeve |
| 26 | $B_4$ | $J_4$ yoke | Positive Portion of A.C. Cycle: Through roller shaft 11b, rectifier 74 and conductor 75, roller shaft 11a, across sidewall of molten metal and back to roller shaft 11b Negative portion of A.C. Cycle: Axially across first roller sleeve, through molten metal sidewall, axially across opposite roller sleeve to a distance spaced from the sidewall, and across the molten metal pool to the first roller sleeve |

In the D.C. embodiment, one of the electromagnets, formed by a coil, (e.g., 28*a*, 28*b* or 26) and associated core, should be supplied with an alternating current to achieve stability in the molten metal at the free edge of the molten metal sidewall. In the A.C. embodiment, described in more detail hereinafter, a single coil (e.g., 24, 26, 28*a*, 28*b* or 81) supplied with alternating current can contain and stabilize the sidewall free surface of the molten metal.

In the case of the A.C. embodiment of the present invention, employing an alternating magnetic field, the magnetic pressure $P_m$ is expressed as:

$$P_m = \frac{B^2(y)}{2\mu_0} \tag{6}$$

where:

$\mu_0$ is the magnetic permeability of the free space. The typical levels of magnetic flux density B(y) should not be less than about 0.7 T and the coefficient $\phi$, in equation (3), should not be less than about 0.76.

In accordance with a preferred feature of the A.C. embodiment of the present invention, a plurality of alternating current frequency values used to generate the alternating magnetic field B(y) can be employed to optimize the magnetic field directly in front of the molten metal sidewall. These currents generate two types of electromagnetic forces within the molten metal. A first (concentrating and shaping) force counterbalances the metallostatic pressure that urges the molten metal axially outwardly due to the molten metal depth (metallostatic pressure). This force is produced primarily by the effects of current flowing through coils 24 and 26. A second (stabilizing) force suppresses instability (e.g., turbulence) within the molten metal sidewall free surface. This force is produced primarily by the effects of current flowing through coil portions 28*a* and 28*b* of coil 28.

Figure 8:
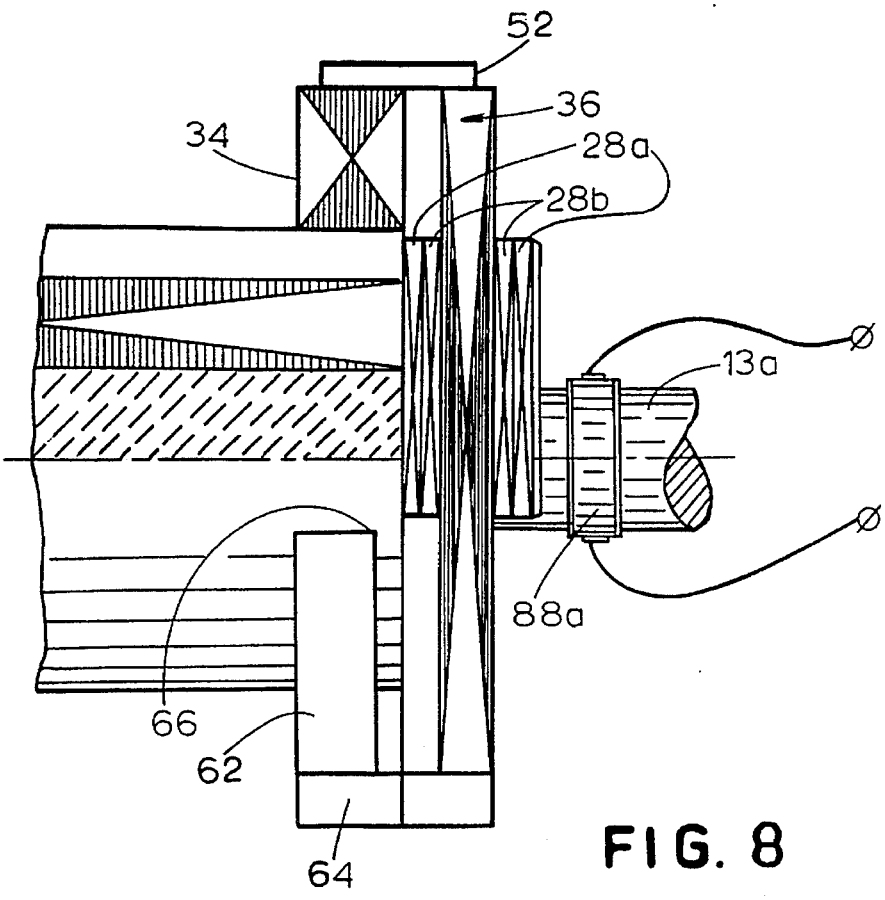
FIG. 8 is a vertical cross-sectional view, partially broken away, of the A.C. magnetic system having coil windings incorporated into the roller taken along the line 8—8 of FIG. 2.
Figure 9:
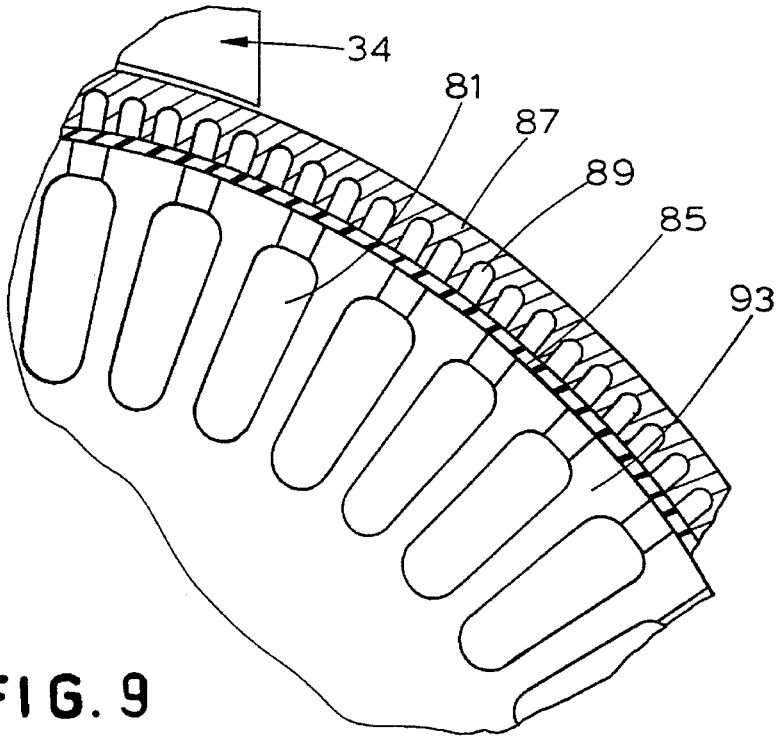
FIG. 9 is an enlarged, partially broken-away view of a portion of a roller used in the A.C. embodiment of the present invention.

In accordance with an important feature of the A.C. embodiment of the present invention, two different alternating current frequency value ranges can be provided through different A.C. coils, or through different sections of the same A.C. coil, to optimize both types of electromagnetic forces. A frequency range of, for example, 1 to about 150 Hz is applied to A.C. coil 24 to provide a primary A.C. vertical magnetic field at the molten metal sidewall, as shown in the A.C. embodiments of the present invention (FIGS. 7–12). The same frequency range of A.C. current is supplied to the A.C. coil windings 81, arranged within a ferromagnetic body portion 93 of the rollers 10 (FIGS. 7–11), that provide a means for concentrating and shaping the A.C. vertical magnetic field. Ferromagnetic body portion 93 of rollers 10 are electrically insulated from the copper sleeves with electrical insulating material 85 (FIG. 9). The coil windings 81, in the rollers 10, provide horizontal current through the copper roller sleeves 87 and the free edge (sidewall) of the molten metal. Horizontal (axial) current flows through the copper roller sleeves, having a relatively high electrical conductivity compared to the contacting molten metal, so that the current flows through the molten metal essentially transversely only at the sidewall being contained.

A higher frequency secondary A.C. vertical magnetic field, produced by the melt-adjacent section 28*a* of coils 28, and a lower frequency, e.g., 1–60 $H_z$, for coil section 28*b*, stabilize the molten metal sidewall in the same manner as described with reference to the functioning of coil 28 in the D.C. embodiment of the method and apparatus of the present invention.

Figure 10:
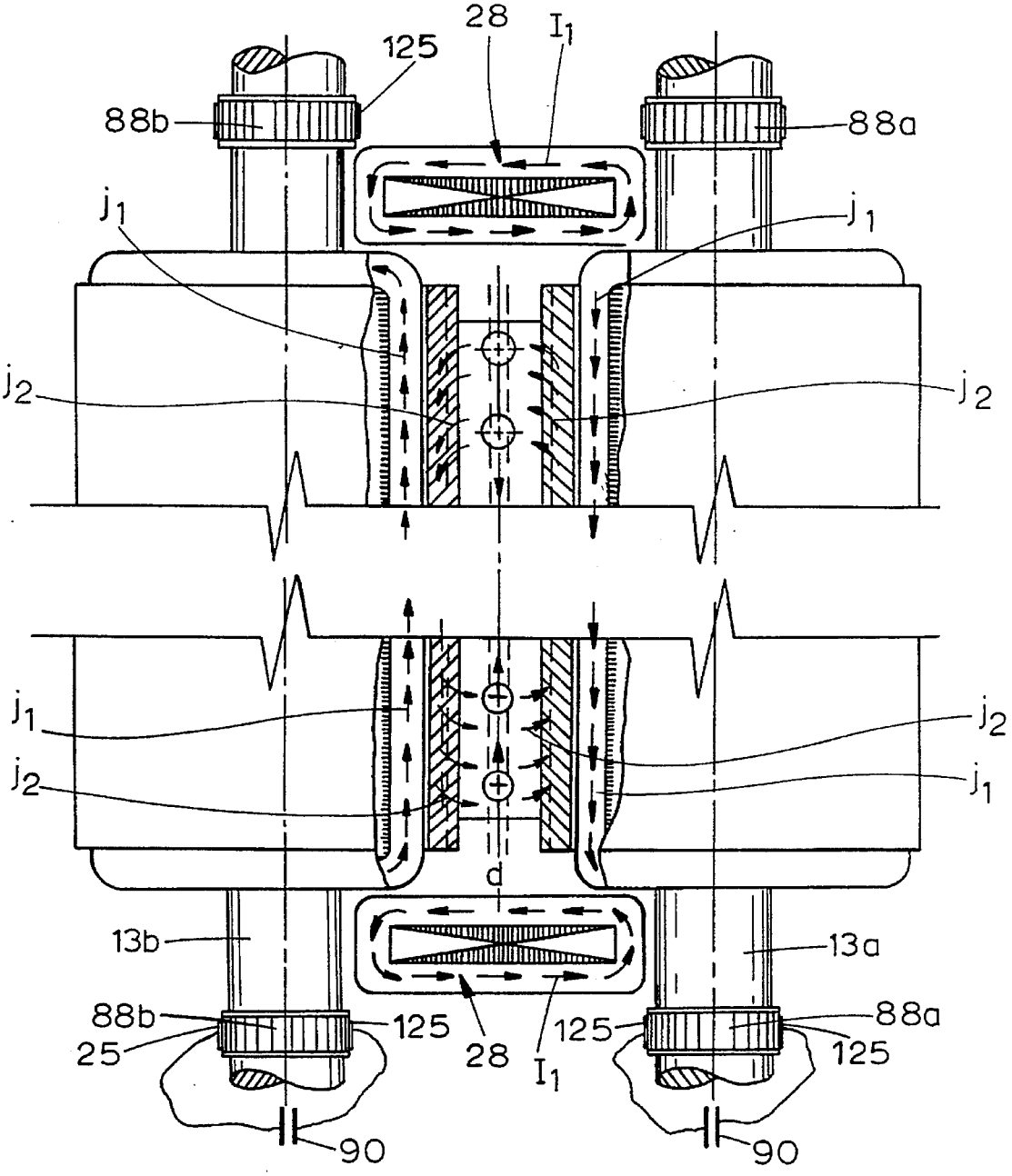
FIG. 10 is a fragmentary plan view, partially in section and partially broken-away, showing a schematic representation of various magnetic and electrical current paths.

In accordance with the A.C. embodiment of the present invention, the outer surfaces of rollers 10 include electrically conductive, e.g., copper, sleeves 87 (see FIG. 9) having a multitude of longitudinal grooves 89 on their inner surfaces, or other cooling means, which provide for the passage of cooling water. The copper sleeves 87 and ferromagnetic (i.e., iron) roller body portion 93 are electrically insulated from each other by a suitable non-conducting material, e.g., heat resistant polymer 85. The windings 81 function in the same manner as the windings of a generator or motor by electrically terminating at electrical collectors 88*a* and 88*b* mounted on roller shafts 13*a* and 13*b*, respectively (FIGS. 8 and 10). The collectors 88*a*, 88*b*, shown in FIGS. 8 and 10, revolve together with the shafts 13*a* and 13*b*.

A.C. coils 24 are mounted on core portions 34 and 36 adjacent to and above the roller edges, and provide a vertical magnetic field at the sidewall of the molten metal, via the vertical magnetic field flowing between pole faces 72, 73 and 66. A.C. coil 24, and the A.C. coil windings 81 of the A.C. electromagnetic circuit are excited by the low frequency (e.g., 1 Hz to 150 Hz) alternating current supplied from one or more A.C. current sources. In a preferred embodiment of the A.C. method, the melt-adjacent coil section 28*a* is supplied by a high frequency (e.g., 150 Hz to 5000 Hz) alternating current, and the inner coil section 28*b* is supplied by D.C. or low frequency (e.g., 1 Hz or 60 Hz) alternating current.

Figure 11:
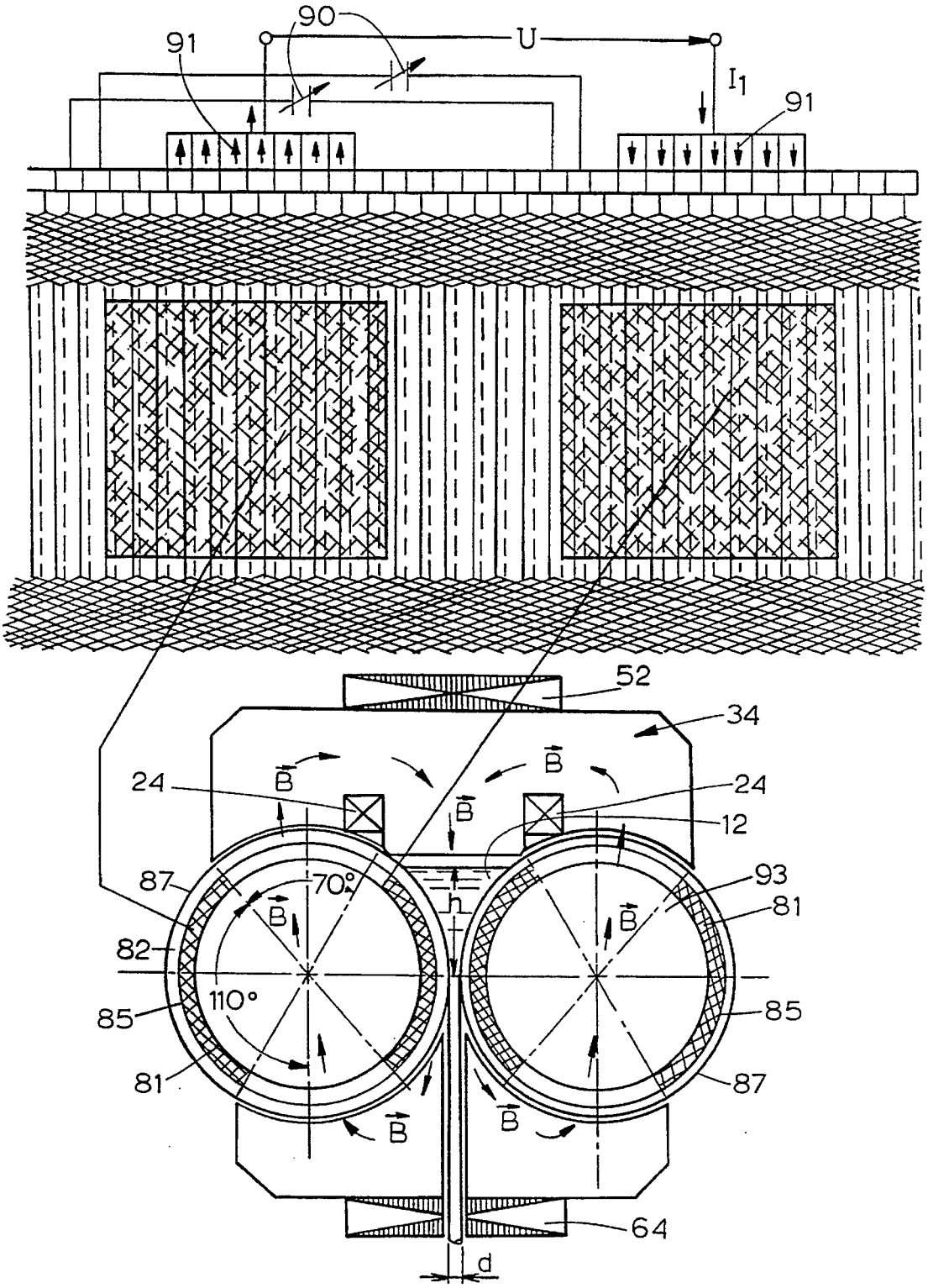
FIG. 11 is an end cross-sectional view of an apparatus in accordance with one A.C. embodiment of the present invention, and an exploded wiring diagram of the coils within the rollers.

The A.C. containment system operates as follows:

A vertical A.C. magnetic field B(y) is produced by A.C. coils 24 and/or by the secondary concentrating and shaping A.C. coil windings 81, arranged around the inner periphery of the ferromagnetic body portion 93 of the rollers 10 (FIGS. 8 to 10). The electrical circuit that includes coil windings 81 also operates as a magnetic field concentrator or shaper, concentrating and shaping the vertical magnetic field from coils 24, similar to the concentrating and shaping function of the coils 26 in the D.C. embodiment of the present invention. Each, or groups, of the multitude of windings 81 is connected to its own individual contact 91 (FIG. 11) of the revolving collectors 88*a* and 88*b* (collectively referred to as collectors 88), shown in FIGS. 8 and 10. The collectors are, in turn, connected to an A.C. power supply (FIG. 11). Each circuit of coil windings 81 within the rollers is connected to a capacitor C (90) in series. These capacitors 90 form a complete electrical circuit with coils 81, rotary electrical contacts 125, (similar to electrical contacts 25 of FIG. 1A in the D.C. embodiment). In this manner, each coil circuit creates a voltage resonant oscillatory RLC circuit, that operates to automatically change the current supplied to coils 81. It should be understood that the coil windings 81 could also be connected to capacitor C in parallel to create resonance of the current in the oscillatory RLC circuit.

The coil 28, to provide its above-described function, should be arranged in close proximity to the molten metal pool edge. In a preferred embodiment, therefore, the coil 28 should be protected against the radiant heat from the molten metal. Water cooling and thermo-insulation can be incorporated into the design of coil 28 to resolve this problem. Through the radiant heat exchange from the liquid metal to the stabilizing coil 28, the coil 28 should be able to absorb practically all Joule heat that evolves at the sidewall of the pool of molten metal 12 due to eddy currents. In accordance with a preferred embodiment of the present invention, the amount of heat capable of being absorbed by the stabilizing A.C. coil 28 is increased by blackening the outer surface of melt-adjacent coil section 28*a*, facing the melt. This provision for external absorption of heat from the molten metal pool constitutes another important feature of the preferred embodiment of the present invention.

In accordance with yet another important and distinct advantage of the method and apparatus of the present invention, control of induced current density within the molten metal pool is achieved, for example as shown in FIG. 10, by varying the frequency of the current $j_1$ supplied to the coil windings 81 of the A.C. circuit. The A.C. vertical magnetic field produced by the A.C. coil windings 81 induces currents $j_2$ within the copper sleeves 87 (FIG. 10) and across the sidewall of the molten metal 12. Because copper has much higher conductivity than the molten metal, currents prefer to travel through copper—copper, and current does not travel across the molten metal except near the sidewalls. As a result, the current $j_2$, though being induced over the full length of the copper sleeves 87 and the whole molten metal pool 12, closes the electrical circuit loop mainly at the molten metal sidewall, by discharging from a copper sleeve and traversing across the sidewall to another copper sleeve at, and closely proximate to, the confined sidewall. The result of this effect provides a concentration of magnetic forces within a zone of the sidewall and, hence, the magnetic pressure produced by these forces is directed inward, at the sidewall, toward the molten metal pool.

The vertical magnetic fields generated by the various power sources and the induced currents and their paths, in the various forms of the A.C. embodiment of the present invention, are shown in Tables III and IV:

TABLE III

MAGNETIC FIELDS AND MAGNETIC FIELD PATHS - A.C. EMBODIMENT

| Coil | Current through Coil | Core(s) (Single or Multiple Turn) | Function | Magnetic Fields | Magnetic Field Paths |
|---|---|---|---|---|---|
| 24 | $I_1$:A.C., e.g., 1–150 $H_z$ | 34, 36 | primary vertical magnetic field | $B_1$ | Across "C" shaped core 36 across poles faces 73 and 66 |
| 28b | $I_2$:A.C. e.g., 1–150 $H_z$ | 36, 58 | stabilizes melt pool | $B_2$ | Through "C"-shaped core 36 and across pole faces 73 and 66 |
| | | | | $B_2$ yoke | Through, and across spaces between, yoke portions 40a and 40b |
| 28a | $I_3$:A.C., e.g., 150–5000 $H_z$ | 36, 58 | shapes and/or concentrates primary vertical magnetic field and stabilizes melt pool | $B_3$ | Through "C"-shaped core 36 and across pole faces 73 and 66 |
| | | | | $B_3$ yoke | Through, and across spaces between, yoke portions 40a and 40b |
| 81 | $I_5$:A.C., e.g., 1–150 $H_z$ | ferromagnetic roller body | shapes and/or concentrates primary vertical magnetic field | $B_5$ | Through ferromagnetic portion 93 of rollers, across roller sleeve 87, vertically through liquid pool 12, and back into ferromagnetic portion 93 of rollers behind coil 81 |

TABLE IV

INDUCED CURRENTS AND CURRENT PATHS - A.C. EMBODIMENT

| Coil w/A.C. | Magnetic Field Generated | Induced Current Resulting From Magnetic Field | Path of Induced Current |
|---|---|---|---|
| 24 | $B_1$ | $J_1$ | Positive Portion of A.C. Cycle: Through roller shaft 11b, rectifier 74 and conductor 75, roller shaft 11a, across sidewall of molten metal and back to roller shaft 11b Negative portion of A.C. Cycle: Axially across first roller sleeve, through molten metal sidewall, axially across opposite roller sleeve to a distance spaced from the sidewall, and across the molten metal pool to the first roller sleeve |
| 28b | $B_2$, $B_2$ yoke | $J_2$, $J_2$ yoke | Positive Portion of A.C. Cycle: Through roller shaft 11b, rectifier 74 and conductor 75, roller shaft 11a, across sidewall of molten metal and back to roller shaft 11b Negative portion of A.C. Cycle: Axially across first roller sleeve, through molten metal sidewall, axially across opposite roller sleeve to a distance spaced from the sidewall, and across the molten metal pool to the first roller sleeve |
| 28a | $B_3$, $B_3$ yoke | $J_3$, $J_3$ yoke | Positive Portion of A.C. Cycle: Through roller shaft 11b, rectifier 74 and conductor 75, roller shaft 11a, across sidewall of molten metal and back to roller shaft 11b Negative portion of A.C. Cycle: Axially across first roller sleeve, through molten metal sidewall, axially across opposite roller sleeve to a distance spaced from the sidewall, and across the molten metal pool to the first roller sleeve |
| 81 | $B_5$ | $J_5$ | Axially across first sleeve, through molten metal sidewall to opposite sleeve, axially across opposite sleeve, and across opposite sidewall, back to first sleeve |
| 24 and/or 28b and/or 28a and/or 26 | $B_5'$ | $J_5'$ | Power source to in-roller coil 81 is off. Current ($J_5'$) in coils 81 is induced from magnetic fields $B_1$, $B_2$, $B_2$ yoke, $B_3$, $B_3$ yoke, and/or $B_4$ which generate currents $I_1$, $I_2$, $I_2$ yoke, $I_3$, $I_3$ yoke and/or $I_4$ which induce current $J_5'$ to power coils 81 |
| 24 and/or 28b and/or 28a | $B_5''$ | $J_5''$ | Power source to in-roller coil 81 is off. Current ($J_5''$) in coils 81 is induced from magnetic fields $B_1$, $B_2$, $B_2$ yoke, $B_3$ and/or $B_3$ yoke, which generate currents $I_1$, $I_2$, $I_2$ yoke and/or $I_3$ yoke which induce current $J_5''$ to power coils 81 |

TABLE V

D.C. AND A.C. ELECTROMAGNETIC SYSTEMS

| System | Coils(s) | Core | Power Supply Voltage | Current Supplied | Magnetic Field Resulting | Induced Current | |
|---|---|---|---|---|---|---|---|
| 1 | 24 | 34, 36, 58 | $PSV_1$ | $I_1$ | $B_1$ | $J_1$ | D.C. or A.C. |
| 2 | 28b | 34, 36, 58 | $PSV_2$ | $I_2$ | $B_2$ | $J_2$ | D.C. or A.C. |
| 2 yoke | 28b if A.C. | 40a, 40b | $PSV_2$ | $I_2$ | $B_2$ yoke | $J_2$ yoke | A.C. |
| 3 | 28a | 34, 36, 58 | $PSV_3$ | $I_3$ | $B_3$ | $J_3$ | A.C. |
| 3 yoke | 28a if A.C. | 40a, 40b | $PSV_3$ | $I_3$ | $B_3$ yoke | $J_3$ yoke | A.C. |
| 4 | 26 | 80 | $PSV_4$ | $I_4$ | $B_4$ | $J_4$ | D.C. or A.C. |
| 5 | 81 | Roller body | $PSV_5$ | $I_5$ | $B_5$ | $J_5$ | A.C. |
| 5' | 81 | Roller body 34, 36, 58, 80 | $PSV_1$ $PSV_2$ $PSV_3$ $PSV_4$ | $I_1$ $I_2$ $I_3$ $I_4$ | $B_1$, $B_2$, $B_3$, and/or $B_4$ induce: $J_5'$ resulting in field: $B_5'$ | $J_5'$ | D.C. or A.C. |
| 5" | 81 | 34, 36, 58, 80 | $PSV_1$ | $I_1$ | $B_1$, | $J_5''$ | D.C. or A.C. |

TABLE V-continued

| D.C. AND A.C. ELECTROMAGNETIC SYSTEMS | | | | | | |
|---|---|---|---|---|---|---|
| System | Coils(s) | Core | Power Supply Voltage | Current Supplied | Magnetic Field Resulting | Induced Current |
| | | or other | $PSV_2$<br>$PSV_3$ | $I_2$<br>$I_3$ | $B_2$, and/or<br>$B_3$<br>induce:<br>$J_5''$<br>resulting in field:<br>$B_5''$ | |

The various electromagnetic systems, for both the D.C. and A.C. embodiments are summarized in Table V.

The embodiments of this invention in which an exclusive property or privilege is claimed are defined as follows:

What is claimed is:

1. A magnetic confining apparatus for preventing the escape of molten metal through an open side of a gap between two horizontally disposed members, between which the molten metal is located, said apparatus comprising:

first electromagnet means for generating a first, mainly vertical magnetic field extending through the open side of said gap to said molten metal to exert a confining pressure against an edge of the molten metal in the gap; and second electromagnet means for forming a second vertical magnetic field, at said molten metal edge, such that the interaction of said two vertical magnetic fields, at said molten metal edge, is sufficient to prevent the molten metal from escaping through the open side of the gap.

2. An apparatus as recited in claim 1, wherein said first electromagnet means comprises a first magnetic core means and a first electrically conductive coil means operatively associated with said first core means, said first core means including upper and lower spaced magnet poles disposed adjacent to the edge of the molten metal.

3. An apparatus as recited in claim 2, wherein said second electromagnet means comprises a second core means and a second electrically conductive coil means operatively associated with said second core means, said second core means including spaced upper and lower magnet poles disposed adjacent to the edge of the molten metal.

4. An apparatus as recited in claim 3, wherein said first and second core means are magnetically interconnected.

5. An apparatus as recited in claim 3 further including a third electrically conductive coil means disposed about a third core means.

6. An apparatus as recited in claim 5 further including two current source means for supplying said first and third coil means with currents of different frequency.

7. An apparatus as recited in claim 5, wherein said third electrically conductive coil means is disposed about the third core means, and wherein the first and third core means are interconnected.

8. An apparatus as recited in claim 2 further including a direct current source operatively connected to said first coil means.

9. An apparatus as recited in claim 2 further including an alternating current source operatively connected to said first coil means.

10. An apparatus as recited in claim 3 further including a direct current source operatively connected to said second coil means.

11. An apparatus as recited in claim 3 further including an alternating current source operatively connected to said second coil means.

12. An apparatus as recited in claim 5 further including an alternating current source operatively connected to said third coil means.

13. An apparatus as recited in claim 5, wherein said third coil means is divided into outer and inner sections, and wherein the inner section is operatively connected to a source of alternating current having a frequency in the range of 1 Hz to about 150 Hz.

14. An apparatus as recited in claim 13, wherein said outer section of said third coil means is operatively connected to a source of alternating current having a frequency in the range of about 150 Hz to about 5000 Hz.

15. An apparatus as recited in claim 1, wherein said second electromagnet means comprises an electrically conductive coil means operatively connected to a ferromagnetic core disposed within at least one of the horizontally disposed members.

16. An apparatus as recited in claim 3, wherein said second electrically conductive coil means is disposed adjacent the molten metal sidewall and between longitudinal shafts of said horizontally disposed members.

17. An apparatus as recited in claim 15, wherein the second electromagnet means is disposed within a hollowed end portion of at least one of the horizontally disposed members.

18. An apparatus as recited in claim 15 further including a direct current source operatively connected to said second electromagnet means.

19. An apparatus as recited in claim 15 further including a alternating current source operatively connected to said second electromagnet means.

20. An apparatus as recited in claim 15, wherein the second electromagnet means is axially disposed within the horizontally disposed member and wherein said second electrically conductive coil means is operatively connected to a ferromagnetic interior portion of said horizontally disposed member.

21. An apparatus as recited in claim 20 further including an alternating current source operatively connected to said second electrically conductive coil means.

22. An apparatus as recited in claim 17, wherein the second electromagnet means includes a ferromagnetic core portion, disposed within the hollowed end portion, that is vertically aligned with, and spaced from, said first core, such that a portion of the magnetic field produced by said electromagnet means within the horizontally disposed member is directed between the magnet poles of the first electromagnet to concentrate the first magnetic field at said molten metal sidewall.

23. An apparatus as recited in claim 17, wherein the second electromagnet means comprises an electrically conductive coil means disposed adjacent an inner surface of the hollowed end portion of said horizontally disposed member, adjacent the molten metal edge, and a ferromagnetic core means operatively associated with said coil means.

24. An apparatus as recited in claim 23, wherein a portion of the horizontally disposed member surrounding the second electromagnet means is formed from an electrically conductive metal.

25. An apparatus as recited in claim 24, wherein the ferromagnetic core portion disposed within the hollowed end portion is magnetically connected to said first electromagnet means.

26. An apparatus as recited in claim 21, wherein said horizontally disposed member includes an electrically conductive sleeve thereover, said sleeve being electrically insulated from the horizontally disposed member and said sleeve having an electrical conductivity greater than an electrical conductivity of said molten metal, such that alternating current supplied to said second electromagnet means induces an alternating current in the sleeve that travels axially along the sleeve, across the edge of the molten metal to an opposite sleeve, axially along the opposite sleeve to an opposite molten metal edge, and back through said opposite molten metal edge to establish a complete current loop through the molten metal edges to shape the vertical magnetic fields at the edges.

27. An apparatus as recited in claim 20, wherein current supplied to said first electromagnet means and the generation of said first vertical magnetic field induces a current in roller mounted coils, thereby generating another vertical magnetic field.

28. An apparatus as recited in claim 1, wherein said horizontally disposed members comprise a first and second electrically conductive rollers having first and second elongate shafts, and wherein said first or second electromagnet means induces an alternating current through a first electric circuit path for providing a complete current loop, said circuit path including a conductor interconnecting said first and second roller shafts to establish a flow of current through said first shaft, through the conductor, through the second shaft, and across the molten metal sidewall.

29. An apparatus as recited in claim 28, wherein the conductor interconnecting the roller shafts includes a rectifier to allow passage of a positive portion of alternating current through said circuit path.

30. An apparatus as recited in claim 29, further including a second electric circuit path for providing a complete current loop for induced current through the molten metal edge, along an electrically conductive outer portion of the first roller, through the molten metal at a location spaced from the molten metal edge, and through an electrically conductive outer portion of the second roller, such that a positive portion of the induced alternating current cycle travels only through the first electric circuit path, and a negative portion of the induced alternating current cycle travels only through the second electric circuit path.

31. An apparatus as recited in claim 24, wherein said hollowed end portions of said horizontally disposed members are formed from a non-magnetic metal such that a portion of said second vertical magnetic field penetrates said end portions of said horizontally disposed members to contact said molten metal edge.

32. An apparatus as defined claim 31, wherein said end portions comprise copper sleeves disposed over a ferromagnetic body portion of said horizontally disposed members.

33. An apparatus as recited in claim 23, wherein said core means, disposed within the hollowed end portion, is generally C-shaped to follow a contour of an inner surface of said hollowed end portion of said horizontal member for shaping said first, mainly vertical magnetic field, and further including an integral second core portion in alignment with a portion of said first core means, said second core portion separated from said first core means by an interposed, hollowed end portion of said horizontally disposed member.

34. An apparatus as recited in claim 28, further including a ferromagnetic yoke means surrounding said roller shafts, and magnetically connected to a first magnetic core means of said first electromagnet means, whereby said yoke means magnetically connects upper and lower portions of said first magnetic core means.

35. A magnetic confining apparatus for preventing the escape of molten metal through an open side of a vertically extending gap between two horizontally spaced members and between which said molten metal is located, said apparatus comprising:

primary magnetic core means;

primary electrically conductive coil means operatively associated with said primary magnetic core means;

said primary magnetic core means comprising a pair of vertically disposed, spaced, magnet poles disposed adjacent the open side of said gap for generating a primary, mainly vertical magnetic field which extends through the open side of said gap to a free edge of said molten metal;

said magnet poles being sufficiently proximate to said free edge of said molten metal so that said generated vertical magnetic field exerts a confining pressure against said free edge of the molten metal in the gap; and electrically conductive secondary coil means operatively associated with secondary magnetic core means, disposed adjacent to said molten metal edge such that current flowing through said secondary coil means creates a secondary vertical magnetic field at said molten metal edge; and third coil means operatively associated with a third magnetic core means, such that current flowing through said third coil means generates a third, mainly vertical magnetic field that induces a horizontal current flow through the edge of the molten metal in the gap and through said two horizontal members.

36. An apparatus as recited in claim 35, wherein the secondary coil means is disposed adjacent to said molten metal edge and separated therefrom by a portion of one of said horizontal members, such that current flowing through said secondary coil means forms said secondary vertical magnetic field at said molten metal edge.

37. An apparatus as recited in claim 36, wherein the secondary core means is vertically aligned with, and spaced from, said primary core means, such that a portion of the magnetic field produced by said secondary electromagnet means is directed between the magnet poles of the first electromagnet means to concentrate the first magnetic field at said molten metal edge.

38. An apparatus as recited in claim 35, wherein said primary magnetic core means is E-shaped, with three legs of the E-shape disposed downwardly, and wherein the primary coil means is disposed between the three legs of the E-shaped primary core means, and a portion of the E-shaped core means is disposed in vertical alignment with the secondary core means.

39. An apparatus as recited in claim 35, wherein the secondary coil means is operatively connected to a ferromagnetic core portion of one of the horizontally disposed members.

40. A magnetic confining apparatus for preventing the escape of molten metal through an open side of a vertically extending gap between two horizontally spaced members and between which said molten metal is located, said apparatus comprising:

a primary magnetic core means comprising ferromagnetic portions of said horizontally spaced members;

a primary electrically conductive coil means disposed within and operatively associated with said primary magnetic core means; and an electrically conducting outer surface portion on said horizontally spaced members, having an electrical conductivity greater than an electrical conductivity of the molten metal.

41. An apparatus as recited in claim 40, further including electrical insulating means disposed between the outer surface of each horizontally spaced member and the primary magnetic core means.

42. An apparatus as recited in claim 40, wherein the coil means includes a plurality of coil windings;

each of said coil windings disposed within the horizontally spaced member being electrically connected to a current supply;

means for supplying current to said coil windings; and means electrically interconnected to the coil windings for changing the current supplied to said coil windings.

43. An apparatus as recited in claim 42, wherein the means for changing the current supplied comprises an independent power supply source and a plurality of capacitors, each electrically interconnected between different coil windings of said primary coil means.

44. A magnetic confining apparatus for preventing the escape of molten metal through an open side of a gap between two horizontally disposed members, between which the molten metal is located, said apparatus comprising:

first electromagnet means, operable with direct current, for generating a first, mainly vertical magnetic field extending through the open side of said gap to said molten metal to exert a confining pressure against a free edge of the molten metal in the gap; and second electromagnet means, operable with alternating current, for inducing a flow of horizontal current through, or proximate to, said edge of the molten metal, such that the resulting magnetic pressure, at said free molten metal edge, is sufficient to prevent the molten metal from escaping through the open side of the gap.

45. An apparatus as recited in claim 44, further including electrical conductor means for electrically connecting shafts of said horizontally disposed members such that said induced horizontal current generated by said second electromagnet means flows through said shafts, through said conductor means, and through said molten metal edge.

46. An apparatus as recited in claim 45 further including rectifying means for rectifying said induced horizontal current generated by said second electromagnet means.

47. An apparatus as recited in claim 44, wherein said first electromagnet means includes a first coil disposed directly above the molten metal edge; and said second electromagnet means includes a second coil disposed in front of the molten metal edge.

48. An apparatus as defined in claim 44, wherein said first electromagnet means includes a pair of spaced, upwardly extending, magnetically interconnected magnet pole faces that are vertically spaced from an upper pole face of said first electromagnet means, said pole faces disposed in front of, spaced from, and proximate to said molten metal edge.

49. The apparatus of claim 44, wherein the direct current is rectified alternating current.

50. A magnetic confining apparatus comprising first and second electromagnet means, wherein said first electromagnet means for generating a first vertical magnetic field includes an E-shaped first magnetic core means, having the legs of the E disposed downwardly and disposed adjacent a first electrically conductive coil means, with the central leg of the E forming an upper pole face; said second electromagnet means for stabilizing the molten metal pool and for shaping said first vertical magnetic field includes a second coil means and a second magnetic core means, said second magnetic core means being integral with said first magnetic core means, and wherein said second magnetic core means is C-shaped, having said second coil means disposed to surround a base portion of the C, with the upper leg of the "C" forming an upper pole face that is horizontally aligned with the upper pole face of the first magnetic core means.

51. A magnetic confining apparatus for preventing the escape of molten metal through an open side of a gap between two horizontally disposed members, between which the molten metal is located, by providing a vertical magnetic field at a free edge of said molten metal in said gap, said apparatus comprising:

electromagnet means for generating a vertical magnetic field for inducing a horizontal alternating current; and circuit means for carrying an induced current flow of said induced horizontal alternating current through, or proximate to, said free edge of the molten metal, from said horizontally disposed members, said induced current associated with said vertical magnetic field at said molten metal edge, such that said vertical magnetic field, at said molten metal edge, is sufficient to prevent the molten metal from escaping through the open side of the gap.

52. A magnetic confining apparatus, as recited in claim 51, wherein said current inducing means comprises:

electrically conductive coil means operatively connected to a ferromagnetic portion of, and disposed within, the horizontally disposed members;

said horizontally disposed members each including an electrically conductive outer portion more conductive than said molten metal, said outer portion being electrically insulated from said ferromagnetic portion of said horizontally disposed members;

an alternating current supply operatively connected to said coil means, such that alternating current supplied to the coil means within the horizontally disposed members induces an oppositely directed current in the electrically conductive outer portion of the horizontally disposed members, such that the induced current flows between the electrically conductive outer portions of the horizontally disposed members across the molten metal, near the free edge of the molten metal, to provide the vertical magnetic field at said molten metal edge.

53. A magnetic confining apparatus, as recited in claim 52, wherein the electrically conductive outer portions of said horizontally disposed members comprise copper sleeves disposed over said horizontally disposed members.

54. A magnetic confining apparatus as recited in claim 1 further including:

a molten metal edge-stabilizer electromagnet means spaced from, and proximately adjacent to said free molten metal edge for generating a molten metal-stabilizing, mainly vertical magnetic field extending through the open side of the gap to said molten metal, thereby stabilizing the molten metal at the free molten metal edge.

55. An apparatus as recited in claim 54, wherein:

said molten metal-stabilizing electromagnetic means comprises a magnetic stabilizer core means and an electrically conductive stabilizer coil means operatively associated with said core means;

said molten metal-stabilizing electromagnetic means generating a mainly vertical magnetic field by current passing through said coil means, said magnetic field serving to stabilize the molten metal at the free edge.

56. An apparatus as recited in claim 54 further including a magnetic field-concentrating electromagnet means for generating a third, mainly vertical magnetic field, including a ferromagnetic concentrator core means operatively associated with a electrically conductive concentrator coil means;

wherein a portion of said concentrator coil means is vertically aligned with a portion of said stabilizer coil means, and the stabilizer core means and concentrator core means are disposed such that upper pole faces of the stabilizer and concentrator core means are in the same horizontal plane; and lower pole faces of the stabilizer and concentrator core means are in another horizontal plane, vertically spaced from the upper pole faces; said pole faces being aligned with said free molten metal edge, wherein the concentrator pole faces are above and below the molten metal edge and substantially aligned therewith; and the stabilizer pole faces are above and below the molten metal edge and horizontally spaced in front thereof, in a direction away from the molten metal free edge.

57. An apparatus as recited in claim 56 further including control means, operatively associated with said concentrator coil means, said concentrator coil means being disposed within a hollowed end portion of each of said horizontally disposed members, for controlling the current supplied to the stabilizer coil means in response to a change in gap distance between the free edge and said stabilizer coil.

58. An apparatus as recited in claim 57, wherein said control means comprises:

a plurality of capacitors, electrically connected in series to said coil means disposed within said horizontally disposed members, through a current collector supplied with alternating current, said collector mounted on said horizontally disposed members; said coil means and connected capacitors establishing an oscillatory RLC circuit together with said stabilizer electromagnet means, such that if a gap distance between the stabilizer coil and the molten metal edge decreases, a mutual inductance also decreases, thereby automatically increasing the current through the stabilizer coil, thus increasing the magnetic field produced by the stabilizer electromagnet means, thereby increasing the gap distance.

59. An apparatus as recited in claim 55, wherein the electromagnet means comprises a melt-adjacent outer coil section operable with alternating current, and an inner, adjacent coil section, electrically insulated from the outer section, said inner coil section operable with direct or alternating current from another current source to further concentrate the vertical magnetic field at the molten metal edge.

60. An apparatus as recited in claim 59, further including a first alternating current power supply connected to said outer coil section, and a second alternating current supply operatively connected to said inner coil section, said first and second alternating current supplies being of different frequency ranges.

61. An apparatus as recited in claim 60, wherein said first alternating current supply has a frequency in the range of about 150 Hz to about 5000 Hz and the second alternating current supply has a frequency of 1 Hz to about 150 Hz.

62. A magnetic confining method for preventing the escape of molten metal through an open side of a vertically extending gap between two horizontally spaced members and between which said molten metal is located, said method comprising the steps of:

disposing a pair of vertically spaced, cooperating magnet poles adjacent to the open side of said gap;

generating, at a location adjacent the open side of said gap, a first vertical magnetic field which extends through the open side of said gap to a free edge of said molten metal from said pair of spaced magnet poles;

generating said first vertical magnetic field sufficiently proximate to said open side of the gap so that said vertical magnetic field has a strength sufficient to exert a confining magnetic pressure against the molten metal in said gap; and generating a second vertical magnetic field, at said molten metal edge, such that the magnetic effect of said two vertical magnetic fields, at said molten metal edge, is sufficient to prevent the molten metal from escaping through the open side of the gap.

63. A method as recited in claim 62, wherein said generating step comprise:

providing a first electrically-conductive coil means surrounding a first magnetic core means adjacent to the open side of said gap for generating said first vertical magnetic field, wherein said magnet poles are disposed sufficiently close to the molten metal for molten metal confinement; and conducting electric current through said first coil means to generate said first vertical magnetic field.

64. A method as recited in claim 62, wherein said electric current is direct current.

65. A method as recited in claim 62, wherein said electric current is alternating current.

66. A method as recited in claim 62, wherein said second vertical magnetic field is generated by flowing electric current through a second coil means operatively associated with a second core means, and wherein said electric current provided to one of said coil means is direct current, and the electric current provided to the other coil means is alternating current.

67. A method as recited in claim 63 further including the step of rectifying the alternating current.

68. A method as recited in claim 63, wherein said second vertical magnetic field is generated by electric current flowing through a second electrically conductive coil means operatively associated with a second magnetic core means, said second electromagnetic coil means mounted adjacent to said molten metal edge, whereby said second vertical magnetic field stabilizes said molten metal edge.

69. A method as recited in claim 68, wherein said second electrically conductive coil means is disposed between the molten metal and longitudinal shafts of said horizontally disposed members.

70. A method as recited in claim 68, wherein said second electromagnet means is mounted within a hollowed end portion of said horizontally disposed members, whereby said second vertical magnetic field penetrates a surface of said hollowed end portions to contact said molten metal edge.

71. A method as recited in claim 70, wherein the current conducted through the first and second coil means is direct electric current.

72. A method as recited in claim 68 further including the steps of:

providing an electrically conducting outer surface portion on said horizontally spaced members, having an electrical conductivity greater than an electrical conductivity of the molten metal, so that current induced in the outer surface portion of the horizontal members, as a result of current directed through an adjacent conductive coil means, flows longitudinally and horizontally through said outer surface portions of said horizontally spaced members and then transversely across said molten metal edge to a spaced outer surface portion of the other horizontally spaced member.

73. A method as recited in claim 72, wherein the outer surface portion of each horizontal member is electrically insulated from the conductive coil means.

74. A method as recited in claim 68, wherein the second conductive coil means includes a plurality of coil windings; and further including the steps of:

connecting the coil windings to a current supply to conduct current through said coil windings within the horizontally spaced member; and changing the current supplied to a melt-facing coil means in response to a change in inductance of the magnetic field at the molten metal edge.

75. A method as recited in claim 72, further including electrically connecting capacitors with the windings of one of said coil means, in series, to provide an oscillatory RLC circuit that is current-responsive to an inductance change.

76. A method as recited in claim 75 further including the step of varying the frequency range of alternating current supplied to the coil windings.

77. A method as recited in claim 68, wherein:

said first conductive coil means is disposed in front of said molten metal edge, and between a pair of longitudinal shafts, each shaft forming part of one of the horizontal members; and further including the step of:

conducting electric current through an electrical conductor that interconnects said pair of longitudinal shafts, across said molten metal edge, by directing electric current into a coil means of said second electromagnet means to induce a current through said molten metal edge, and through said electrical conductor means to form said second vertical magnetic field.

78. A magnetic confining method for preventing the escape of molten metal through an open side of a vertically extending gap between two horizontally spaced members and between which said molten metal is located, said method comprising the steps of:

providing a primary magnetic core means and a primary electrically conductive coil means operatively associated with said primary magnetic core means;

said magnetic core means comprising a pair of vertically disposed, spaced, magnet poles disposed adjacent the open side of said gap for generating a primary, mainly vertical magnetic field which extends through the open side of said gap to said molten metal;

said magnet poles being sufficiently proximate to said open side of the gap so that said generated vertical magnetic field exerts a confining pressure against any edge of the molten metal in the gap;

providing an electrically conductive secondary coil means operatively associated with a secondary magnetic core means, disposed adjacent to said molten metal edge, and conducting a current through said secondary coil means to create a secondary vertical magnetic field that shapes and concentrates the primary vertical magnetic field at the molten metal edge; and flowing a horizontal current through the edge of the molten metal in the gap and through said two horizontal members, to generate a third, mainly vertical magnetic field that exerts additional confining pressure against said edge of the molten metal in said gap, and confines and shapes the primary vertical magnetic field primarily to said molten metal edge.

79. A magnetic confining apparatus for preventing the escape of molten metal through an open side of a gap between two horizontally disposed members, between which the molten metal is located, said apparatus comprising:

first electromagnet means, operable with direct current, for generating a first, mainly vertical magnetic field extending through the open side of said gap to said molten metal to exert a confining pressure against a free edge of the molten metal in the gap;

second electromagnet means, operable with alternating current, for inducing a flow of horizontal current through, or proximate to, said edge of the molten metal, such that the resulting magnetic pressure, at said free molten metal edge, is sufficient to prevent the molten metal from escaping through the open side of the gap;

a third electromagnet means comprising a third electrically conductive coil means operatively associated with a third core means, said third electromagnet means mounted adjacent to said molten metal edge; and a current source operatively connected to said third electrically conductive coil means thereby generating a third vertical magnetic field at said molten metal edge, wherein said third vertical magnetic field stabilizes the molten metal pool and shapes the magnetic field at said molten metal edge.

* * * * *

UNITED STATES PATENT AND TRADEMARK OFFICE

CERTIFICATE OF CORRECTION

PATENT NO. : 5,495,886

DATED : March 5, 1996

INVENTOR : Kolesnichenko

It is certified that error appears in the above-identified patent and that said Letters Patent is hereby corrected as shown below:

Column 1, line 67, "praeg U.S." should be --Praeg U.S.--.

Column 12, line 29, "$\phi$ in" should be --$\varphi$ in--.

Column 12, line 30, "coefficient $\phi$" should be --coefficient $\varphi$--.

Column 12, line 31, "$\phi=0.76$" should be --$\varphi=0.76$--.

Column 13, line 48, "coefficient $\phi$," should be --coefficient $\varphi$,--.

Column 25, line 3, "in claim 1" should be --in claim 51--.

Signed and Sealed this

Third Day of September, 1996

*Attest:*

Bruce Lehman

BRUCE LEHMAN

*Attesting Officer*

*Commissioner of Patents and Trademarks*